US007202846B2

(12) United States Patent
Maeda et al.

(10) Patent No.: US 7,202,846 B2
(45) Date of Patent: Apr. 10, 2007

(54) SIGNAL LINE DRIVE CIRCUIT AND DISPLAY DEVICE USING THE SAME

(75) Inventors: Kazuhiro Maeda, Nara (JP); Sachio Tsujino, Yao (JP); Keiji Takahashi, Tenri (JP); Hajime Washio, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 272 days.

(21) Appl. No.: 10/440,077

(22) Filed: May 15, 2003

(65) Prior Publication Data

US 2004/0008173 A1 Jan. 15, 2004

Related U.S. Application Data

(63) Continuation-in-part of application No. 10/304,608, filed on Nov. 26, 2002, now abandoned.

(30) Foreign Application Priority Data

Nov. 30, 2001 (JP) ..... 2001-366979
May 17, 2002 (JP) ..... 2002-142519
Sep. 6, 2002 (JP) ..... 2002-262141

(51) Int. Cl.
*G09G 3/36* (2006.01)

(52) U.S. Cl. ..... 345/98; 345/204

(58) Field of Classification Search ..... 345/87, 345/90, 92, 93, 97, 98, 100, 204, 205, 88, 345/89, 91, 94, 95, 96
See application file for complete search history.

(56) References Cited

U.S. PATENT DOCUMENTS 5,939,833 A * 8/1999 Song et al. ..... 315/169.1
6,339,411 B2 * 1/2002 Miyazaki et al. ..... 345/1.1
6,480,181 B2 * 11/2002 Ishii ..... 345/100

(Continued)

FOREIGN PATENT DOCUMENTS

CN 1310435 A 8/2001

(Continued)

*Primary Examiner*—Richard Hjerpe
*Assistant Examiner*—Jean Lesperance
(74) *Attorney, Agent, or Firm*—David G. Conlin; William J. Daley, Jr.; Edwards Angell Palmer & Dodge LLP

(57) ABSTRACT

A data signal line drive circuit is provided with: a shift register belonging to a system, whose stages correspond to respective sampling units for driving odd-number-th data signal lines; and a shift register belonging to another system, whose stages correspond to respective sampling units for driving even-number-th data signal lines. On the occasion of low-resolution mode, only either of the shift registers is operated, and in accordance with the outputs from the respective stages of the shift register which has been operated, timing signals, which are supplied to the sampling units corresponding to the stages of both shift registers, are generated. With this arrangement, even if one of input signals each having different signal line resolution is inputted, a signal line drive circuit which consumes a small amount of electric power can be realized, while it is possible to specify the timings of the operation of signal line drive sections for driving signal lines, in accordance with the input signal.

48 Claims, 23 Drawing Sheets

U.S. PATENT DOCUMENTS

| | | | | |
|---|---|---|---|---|
| 2001/0048408 | A1 | 12/2001 | Koyama et al. | |
| 2002/0075249 | A1* | 6/2002 | Kubota et al. | 345/204 |

FOREIGN PATENT DOCUMENTS

| | | | |
|---|---|---|---|
| EP | 0 821 338 | A2 | 1/1998 |
| JP | 01-119191 | | 5/1989 |
| JP | 06-274122 | | 9/1994 |
| JP | 08-122747 | | 5/1996 |
| JP | 2000-181414 | | 6/2000 |
| JP | 2000-322032 | | 11/2000 |

* cited by examiner

SIGNAL LINE DRIVE CIRCUIT AND DISPLAY DEVICE USING THE SAME

This is a continuation in part application of a U.S. patent application Ser. No. 10/304,608 titled "SIGNAL LINE DRIVE CIRCUIT AND DISPLAY DEVICE USING THE SAME" filed on Nov. 26, 2002 now abandoned.

FIELD OF THE INVENTION

The present invention relates to a signal line drive circuit which is low-power consumption type as well as capable of driving a plurality of signal lines at respective operating timings in accordance with a supplied input signal which is one of input signals each having different signal line resolution, and a display device using the same.

BACKGROUND OF THE INVENTION

For instance, as illustrated in FIG. 16, a pixel array 102 of an active matrix image display device 101 is provided with a plurality of data signal lines SL1–SLn, a plurality of scanning signal lines GL1–GLm, and pixels PIX (1, 1) through PIX (n, m) which are provided in a matrix manner and corresponding to respective pairs of the data signal lines SL1–SLn and the scanning signal lines GL1–GLm.

A control circuit 106 outputs an image signal DAT which indicates an image. Here, in a time division manner, the image signal DAT transmits the sets of image data D each indicating the display condition of the corresponding pixel displaying an image, and the control circuit 106 outputs a clock signal SCK and a start pulse signal SSP, as timing signals for correctly displaying the image signal DAT by the pixel array 102, to a data signal line drive circuit 103, and also outputs a clock signal GCK and a start pulse signal GSP to a scanning signal line drive circuit 104.

Also, the scanning signal line drive circuit 104 sequentially selects the scanning signal lines GL1–GLm of the pixel array 102, in sync with timing signals such as the clock signal GCK.

Moreover, the data signal line drive circuit 103 is operated in sync with timing signals such as the clock signal SCK, so as to specify the timings in accordance with the respective data signal lines SL1–SLn, and sample the image signals DAT at these timings. Further, the data signal line drive circuit 103 amplify the results of the sampling as occasion demands, and then writes the results into the data signal lines SL1–SLn.

In contrast, a pixel PIX(i, j) controls its brightness in accordance with the data written in the corresponding data signal line SLi, during a period (horizontal period) when the corresponding scanning signal line GLj is selected. This enables to display the image specified by an image signal DAT on the pixel array 102. Here, i is an arbitrary integral number not more than the number of the data signal lines SL1–SLn, and j is an arbitrary integral number not more than the number of the scanning signal lines GL1–GLm.

As illustrated in FIG. 17, provided that a start pulse signal SSP is supplied to a first stage L1 of a shift register SR of the data signal line drive circuit 103, the shift register SR shifts the outputs of stages L1 through L(n−1) to the next stages Ln+1 through Ln, respectively, with a predetermined shift cycle indicated as a clock signal SCK. As a result, as illustrated in FIG. 18, the output signal waveforms of latch circuits L1–Ln constituting the respective stages of the shift register SR become respective signal waveforms O1–On in which the phase difference between neighboring waveforms is equal to one shift cycle.

The output signals O1–On are, as FIG. 17 shows, subjected to the adjustment of pulse width in respective wave shaping circuits WE1–WEn, and then the output signals O1–On are subjected to buffering in respective buffer circuits BF1–BFn, so as to be outputted as timing signals T1–Tn.

In contrast, the data signal line drive circuit 103 is provided with a sampling section 111 composed of sampling units SU1–SUn corresponding to the respective data signal lines SL1–SLn. A sampling unit SUi outputs an image signal DAT to a data signal line SLi, during a period indicated by a timing signal Ti. For this reason, the result of the sampling of the image signal DAT, at the timing when the timing signal Ti indicates the stop of outputting, is written into a pixel PIX(i, j).

Here, the control circuit 106 outputs a clock signal SCK which indicates shift cycle in sync with sampling cycle of the image signal DAT. This enables the data signal line drive circuit 103 to properly sample the image signal DAT, so that the image display device 101 can display the image specified by the image signal DAT.

By the way, when the resolution of the image signal DAT varies, the number of pixels constituting one image varies in longitudinal and lateral directions. Thus, the number of scanning periods for displaying one image by the image signal DAT and the number of sampling timings in one scanning period also vary.

Moreover, to display images of different image signals DAT in an identical size, it is necessary to change the distance between neighboring pixels (distance between the centers of the respective pixels). However, being different from CRTs (Cathode-Ray Tubes), in the image display device 101, the distance between the pixels PIX is fixed at the distance between the data signal lines SL1–SLn or the scanning signal lines GL1–GLm, so that it is not possible to change actual signal line resolution.

Thus, to drive the pixel array 102 with actual signal line resolution of the image display device 101 on the occasion of the input of an image signal DAT having signal line resolution lower than the actual signal line resolution, there is an image display device which has been proposed (cf. Japanese Laid-Open Patent Application No. 6-274122/1994 (Tokukaihei 6-274122); published on Sep. 30, 1994), arranged in such a manner that a control circuit is provided between a signal source of an image signal DAT and a data signal line drive circuit, so that, when an image signal DAT having signal line resolution lower than the actual signal line resolution of the image display device 101 is inputted, in order to interpolate necessary image data, the control circuit generates an interpolating image signal and an interpolating clock in sync with the same, and supplies them to the data signal line drive circuit.

However, in this conventional art, the interpolating image signal and the interpolating clock are generated in order to interpolate necessary image data, even in low-resolution mode. Thus, in this case, the number of pulses of a clock signal (clock signal after the interpolation) in one horizontal period, the clock signal being supplied to the data signal line drive circuit, is identical with the number on the occasion of high-resolution mode. For this reason, it is difficult to sufficiently reduce the operating speed of a circuit (such as the foregoing control circuit) for supplying the image signal DAT to the data signal line drive circuit, and it is also difficult to reduce the power consumption.

Furthermore, in this case, the data signal line drive circuit generates the timing signals Ti in accordance with the output signals from all stages (latch circuits L1, L2, . . . ) of the shift register SR in FIG. 16, both in high-resolution mode and low-resolution mode. This again causes the difficulty in reducing the power consumption of the data signal line drive circuit.

SUMMARY OF THE INVENTION

The objective of the present invention is to realize (i) a signal line drive circuit which consumes a small amount of electric power at the same time makes it possible to specify the timings of the operation of signal line drive sections (such as sampling units SU) for driving signal lines, in accordance with the input signals, even if one of input signals each having different signal line resolution is inputted, and (ii) a display device using the circuit of (i).

To achieve the foregoing objective, the signal line drive circuit in accordance with the present invention comprises a scanning section for outputting timing signals to respective signal line drive sections provided in accordance with a plurality of signal lines, the timing signals specifying timings of the signal line drive sections being operated in accordance with an input signal, wherein, the scanning section includes: a plurality of shift registers of respective systems; and control means for controlling operation or non-operation of at least one of the shift registers of respective systems, in accordance with signal line resolution of the input signals.

In this arrangement, it is possible to control the number of the shift registers, of respective systems, to be operated, in accordance with the signal line resolution of the input signals. Thus, in accordance with the signal line resolution, i.e. in accordance with the number of timings instructed to the signal line drive sections on occasion when the signal line drive sections, which are for driving signal lines, are operated in accordance with the input signals, the total number of the stages of at least one shift register which has been operated can be controlled. As a result, the scanning section can output the timing signals which specify operating timings of the signal line drive sections, without hindrance.

Moreover, when the signal line resolution is low, a part of the shift registers is stopped and this makes it possible to reduce the power consumption to be lower than the power consumption in the arrangement of conventional art, i.e. the arrangement in which the total number of stages of a shift register which has been operated is unchanged, regardless of the level of the signal line resolution.

Consequently, on the both occasions of the input of an input signal of high signal line resolution and the input of an input signal of low signal line resolution, although proper operating timings can be instructed to respective signal line drive sections, a signal line drive circuit which consumes a small amount of electricity can be realized.

Further, to achieve the foregoing objective, the signal line drive circuit in accordance with the present invention comprises a scanning section for outputting timing signals to respective signal line drive sections provided in accordance with the plurality of signal lines, the timing signals specifying timings of the signal line drive sections being operated in accordance with an input signal, wherein, the scanning section includes: first and second shift registers each belonging to a different system; and control means which causes the first and second shift registers to be operated in case of high-resolution mode, and causes the first shift register to be stopped in case of low-resolution mode in which mode input signals whose signal line resolution is lower than that of an input signal in the case of high-resolution mode is supplied. Here, each of the first and second shift registers may be a shift register of a single system, or may be a plurality of shift registers of respective systems.

In this arrangement, on the occasion of high-resolution mode, the control means causes both of the first and second shift registers to be operated so that the total number of the stages of the shift registers which has been operated is larger than the number on the occasion of low-resolution mode. Thus, the signal line resolution of the input signals in this case is higher than the signal line resolution on the occasion of low-resolution mode, and hence the scanning section can output the timing signals specifying the operating timings of the signal line drive sections without hindrance, even if there are a lot of timings to be instructed to the signal line drive sections on occasion when the signal line drive sections are operated in accordance with the input signals for driving the signal lines, such as timings for sampling the data included in the input signals and timings for switching lines corresponding to the data included in the input signals.

In contrast, on the occasion of low-resolution mode, the control means causes the first shift register to be stopped, while the second shift register to be operated. In this case, the number of the stages of the shift register to be operated is fewer than the number on the occasion of high-resolution mode, so that the number of timings to be instructed to the respective signal line drive sections is also few. Thus, even if the first shift register has been in the state of non-operation, the scanning section can output the timing signals specifying the foregoing timings to the signal line drive sections without hindrance.

In the foregoing arrangement, the first shift register has been stopped on the occasion of low-resolution mode. Moreover, since the first shift register belongs to a system different from a system to which the second shift register belongs, the arrangement enables to reduce the power consumption to be smaller than the power consumption in the case of the arrangement of the conventional art, i.e. the arrangement in which, regardless of the signal line resolution, the total number of the stages of the shift registers which have been operated is unchanged.

Incidentally, provided that one shift register of a single system is provided and a pulse is shifted bypassing some stages on the occasion of low-resolution mode, it is possible to restrain the operating speed which is necessary for the second register. Thus, the foregoing arrangement enables to constitute the second shift register by a circuit which consumes a smaller amount of electricity.

Consequently, on the both occasions of the input of input signals of high signal line resolution and the input of input signals of low signal line resolution, a signal line drive circuit which consumes a small amount of electricity can be realized, while proper operating timings can be instructed to respective signal line drive sections.

To achieve the foregoing objective, the signal line drive circuit in accordance with the present invention comprises a scanning section for outputting timing signals to respective signal line drive sections provided in accordance with a plurality of signal lines, the timing signals specifying timings of the signal line drive sections being operated in accordance with an input signal, wherein, the scanning section includes: a shift register; and control means which (i) determines whether or not shifted signals are shifted bypassing at least one stage of the shift register, in accordance with signal line resolution of the input signal, and (ii) stops operation of the stage which has been bypassed.

In this arrangement, on the occasion of low-resolution mode in which mode an input signal whose signal line resolution is lower than the signal line resolution of input signals on the occasion of high-resolution mode is supplied, the control means causes a shifted signal to be shifted bypassing at least one of the stages of the shift register. In this case, the number of stages of the shift register which has been operated is smaller than the number of stages on occasion when no stages are bypassed. However, since the signal line resolution of the input signal in this case is lower than the same on the occasion of high-resolution mode, the number of timings to be instructed to the signal line drive sections also becomes fewer. On this account, although the shifted signal is shifted bypassing at least one stage of the shift register, the scanning section can output the timing signals, which specify the foregoing timings, to the signal line drive sections without hindrance, and at the same time the scanning section can cause the stage(s), which has (have) been bypassed, to be stopped.

Consequently, on the both occasions of the input of an input signal of high signal line resolution and the input of an input signal of low signal line resolution, although proper operating timings can be instructed to respective signal line drive sections, a signal line drive circuit which consumes a small amount of electricity can be realized.

To achieve the foregoing objective, the display device in accordance with the present invention comprises: a plurality of data signal lines; a plurality of scanning signal lines intersecting with the plurality of data signal lines; pixels which correspond to respective pairs of the plurality of data signal lines and the plurality of scanning signal lines, so as to be provided as, for instance, a matrix manner; a scanning signal line drive circuit for driving the scanning signal lines; and a data signal line drive circuit for outputting output signals, which correspond to respective sampling results supplied from sampling circuits provided in accordance with the plurality of data signal lines, to the plurality of data signal lines, wherein at least either one of the scanning signal line drive circuit and the data signal line drive circuit is one of the foregoing signal line drive circuits.

The signal line drive circuits with the foregoing arrangements consume a small amount of electric power but at the same time the signal line drive sections can drive the respective signal lines at proper operating timings, on the both occasions of the input of input signals of high signal line resolution and the input of input signals of low signal line resolution. Thus, adopting one of the foregoing signal line drive circuit as at least either one of the scanning signal line drive circuit and the data signal line drive circuit makes it possible to realize a display device which can properly display both an image signal of high resolution and an image signal of low-resolution, at the same time consumes a small amount of electricity.

For a fuller understanding of the nature and advantages of the invention, reference should be made to the ensuing detailed description taken in conjunction with the accompanying drawings.

DESCRIPTION OF THE EMBODIMENTS

[First Embodiment]

The following description will discuss an embodiment in accordance with the present invention in reference to FIGS. 1 through 10. An image display device (display device) 1 in accordance with the present embodiment, corresponding to image sources with various resolutions, is arranged in such a manner that a drive section of a data signal line drive circuit is controlled in accordance with resolution modes so that not only high-definition displaying with the assistance of resolution variation function but also the reduction of the power consumption can be realized.

Figure 2:
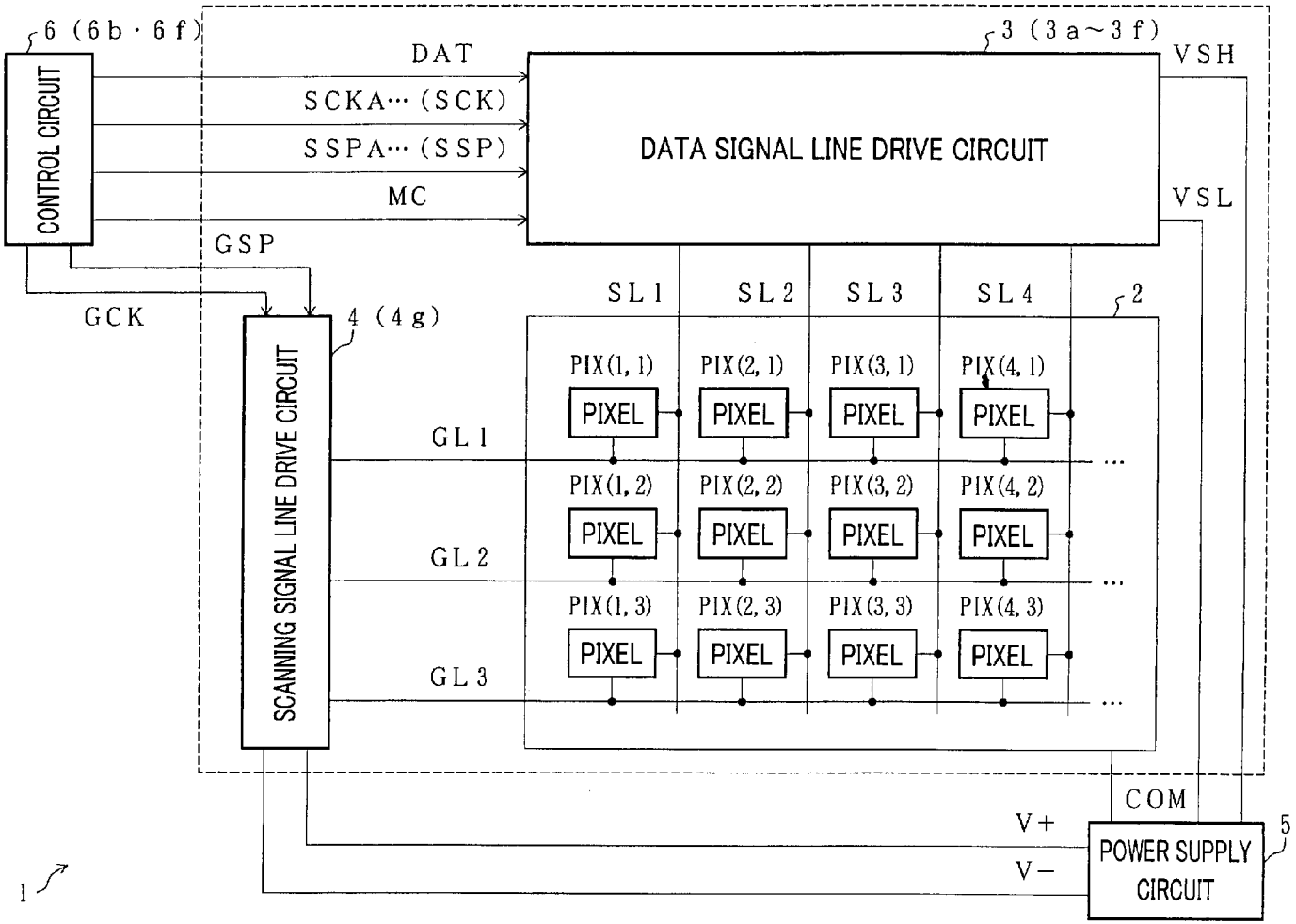
FIG. 2 is a block diagram, illustrating a substantial part of an image display device including the data signal line drive circuit.

As FIG. 2 illustrates, the image display device 1 includes: a pixel array 2 including pixels PIX(1, 1) through PIX(n, m) provided in a matrix manner; a data signal line drive circuit 3 for driving data signal lines SL1–SLn of the pixel array 2; a scanning signal line drive circuit 4 for driving scanning signal lines GL1–GLm of the pixel array 2; a power supply circuit 5 for supplying electric power to the drive circuits 3 and 4; and a control circuit (clock signal control means) 6 for supplying a control signal to the drive circuits 3 and 4. Incidentally, in claims, a signal line drive circuit corresponds to the data signal line drive circuit 3 and signal lines correspond to the data signal lines SL1–SLn.

Now, before describing an arrangement of the data signal line drive circuit 3 in detail, a schematic arrangement and operation of the image display device 1 on the whole will be described. In the description, for convenience' sake, numbers or characters specifying the locations are added only in case of necessity (e.g. a data signal line SLi which is i-th data signal line SL), and when it is not necessary to specify the locations or when a member is generally indicated, the characters indicating the locations are omitted.

The pixel array 2 includes: a plurality of (n in this case) data signal lines SL1–SLn; and a plurality of (m in this case) scanning signal lines GL1–GLm intersecting with the data signal lines SL1–SLn. Provided that an integral number arbitrarily selected from numbers 1 through n is i and an integral number arbitrarily selected from numbers 1 through m is j, a pixel PIX(i, j) is provided in accordance with the combination of a data signal line SLi and a scanning signal line GLj.

In the present embodiment, the pixel PIX(i, j) is provided in an area surrounded by two neighboring data signal lines SL(i−1) and SLi and two neighboring scanning signal lines GL(j−1) and GLj.

Figure 3:
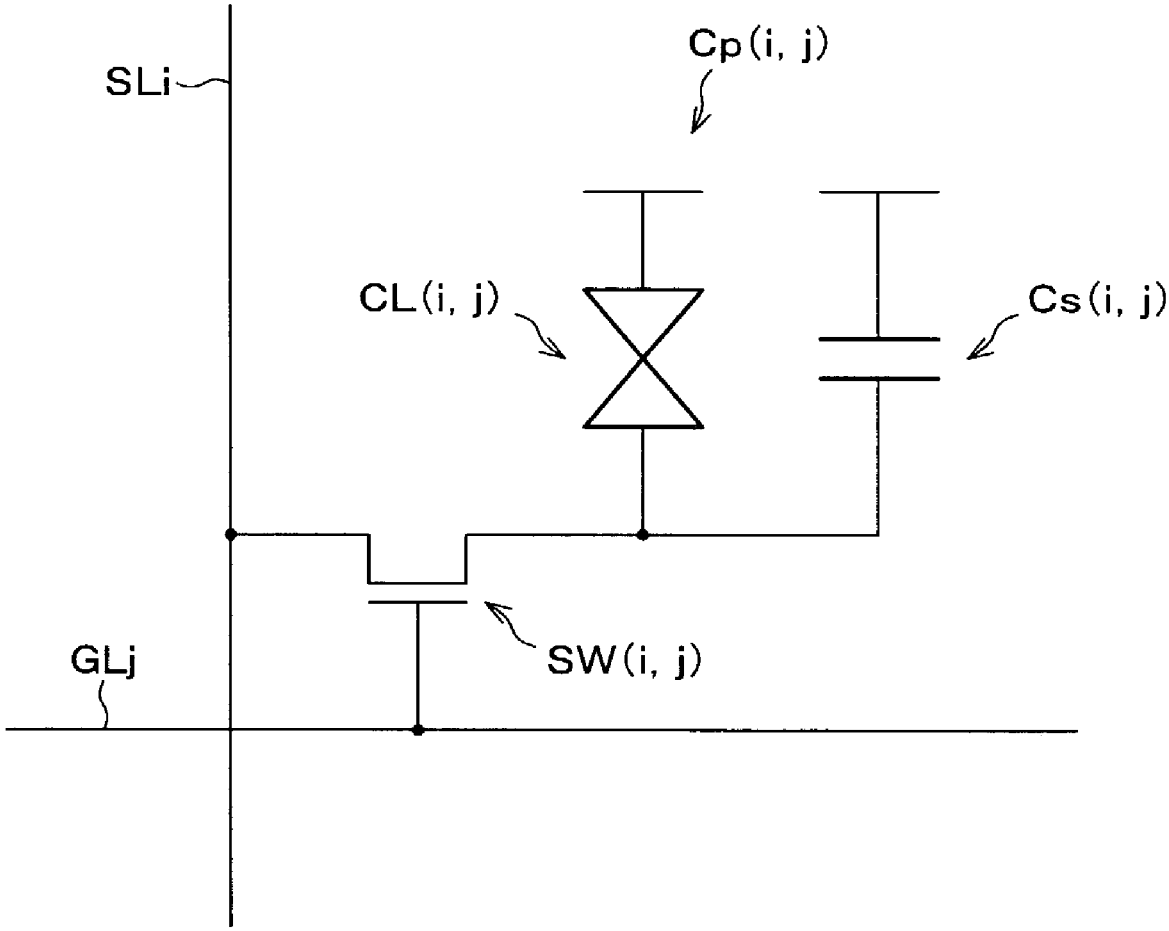
FIG. 3 illustrates a schematic circuit arrangement of a pixel provided in the image display device.

For instance, provided that the image display device 1 is a liquid crystal display device, as illustrated in FIG. 3, the pixel PIX(i, j) includes: a field-effect transistor SW(i, j) as a switching element, whose gate is connected to the scanning signal line GLj and whose drain is connected to the data signal line SLi; and a pixel capacitor Cp(i, j), either one of whose electrodes being connected to the source of the field-effect transistor SW(i, j). Here, the other electrode of the pixel capacitor Cp(i, j) is connected to a common electrode line which is shared by all pixels PIX, and the pixel capacitor Cp(i, j) is composed of a liquid crystal capacitor CL(i, j) and an auxiliary capacitor Cs(i, j) which is added as the need arises.

In the pixel PIX(i, j), when the scanning signal line GLj is selected, the field-effect transistor SW(i, j) is brought into conduction and a voltage applied to the data signal line SLi is applied to the pixel capacitor Cp(i, j). In the meantime, during the period of shutting the field-effect transistor Sw(i, j) off, which is after the period during which the scanning signal line GLj is selected, the pixel capacitor Cp(i, j) keeps the voltage at the time of the shutoff. Here, the transmittance or reflectance of liquid crystal varies in accordance with the voltage applied to the liquid crystal capacitor CL(i, j). Thus, the scanning signal line GLj is selected and a voltage in accordance with image data D supplied to the pixel PIX(i, j) is applied to the data signal line SLi, so that it is possible to change the condition of displaying of the pixel PIX(i, j), in line with the image data D.

Although liquid crystal is adopted in the foregoing description, the pixel PIX(i, j) may be alternatively arranged no matter whether or not the pixel is self-luminous, on condition that the brightness of the pixel PIX(i, j) can be controlled in accordance with the value of a signal applied to the data signal line SLi, during the period in which a signal indicating the selection has been applied to the scanning signal line GLj.

According to the foregoing arrangement, the scanning signal line drive circuit 4 illustrated in FIG. 2 outputs a signal indicating either the select period or non-select period, such as a voltage signal. Also, the scanning signal line drive circuit 4 changes the scanning signal line GLj, which outputs a signal indicating the select period, in accordance with timing signals such as a clock signal GCK and a start pulse signal GSP which are supplied from the control circuit 6. Thus, the scanning signal lines GL1–GLm are sequentially selected at predetermined timings.

Moreover, as an image signal DAT, the data signal line drive circuit 3 samples image data D which is inputted to the pixels PIX in a time division manner, at predetermined timings. Further, the data signal line drive circuit 3 outputs output signals in accordance with the image data D to the respective pixels PIX(1, j) through PIX(n, j) corresponding to the scanning signal line GLj which has been selected by the scanning signal line drive circuit 4, via the respective data signal lines SL1–SLn.

Here, the image signal DAT has one of predetermined resolutions, and in the present embodiment, the image signal DAT is supplied from the control circuit 6 along with a resolution switching signal MC which specifies the resolution. Also, the data signal line drive circuit 3 determines the timings of sampling and the timings of outputting the output signals, in accordance with the timing signals such as a clock signal SCK and a start pulse signal SSP.

Meanwhile, the pixels PIX(1, j)–PIX(n, j) adjust the luminance when emitting light or the transmittance so as to determine their brightness in accordance with the output signals supplied to the data signal lines SL1–SLn corresponding to the respective pixels PIX(1, j)–PIX(n, j), during the period in which the corresponding scanning signal line GLj has been selected.

Here, the scanning signal line drive circuit 4 sequentially selects the scanning signal line GL1–GLm, and hence it is possible to arrange all of the pixels PIX(1, 1)–PIX(n, m) of the pixel array 2 to have the brightness specified by the corresponding image data D, and the image displayed on the pixel array 2 can be renewed.

As an example of the image signals DAT of different resolutions, the following description will discuss a case which is arranged in such a manner that, either one of the image signal DAT of high-resolution or the image signal DAT of low-resolution is supplied to the data signal line drive circuit 3, and on the occasion of low-resolution, the image signal DAT whose signal line resolution is half as much as that of the image signal DAT of high-resolution is inputted.

In this case, when an image signal DAT of high-resolution is applied, the data signal line drive circuit 3 outputs an output signal in accordance with a single image data D to one data signal line SLi, and when an image signal DAT of low-resolution is applied, the data signal line drive circuit 3 outputs an output signal in accordance with a single image data D to two neighboring data signal lines SLi and SL(i+1). Thus, it is possible to match the apparent horizontal resolution (signal line resolution) with the horizontal resolution of the image signal DAT. For this reason, it is possible to display a high-definition image by an image display device 1, even if the horizontal resolution of the image signal DAT which has been supplied is lower than the horizontal maximum display resolution in physical terms of the image display device 1, in such a case as the image display device 1 whose maximum display resolution in physical terms is equivalent to, for instance, the maximum display resolution of UXGA (Ultra-eXtended Graphics Array) displays an image specified by an image signal DAT for SVGA (Super Video Graphics Array).

Figure 1:
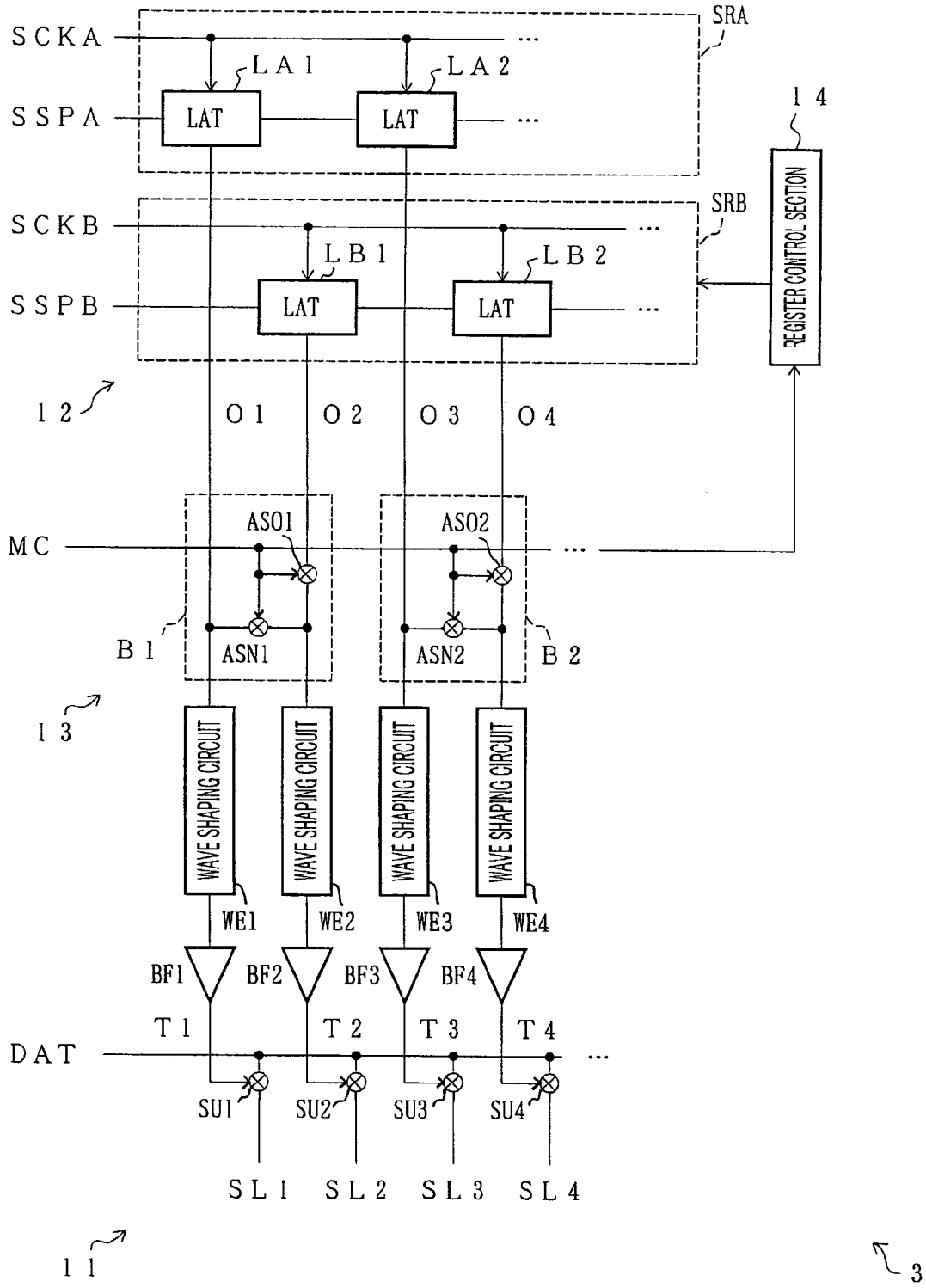
FIG. 1 is a block diagram related to an embodiment in accordance with the present invention, illustrating an arrangement of a substantial part of a data signal line drive circuit.

The data signal line drive circuit 3 is, as illustrated in FIG. 1, provided with a sampling section 11 which is composed of sampling units (signal line drive units; sampling circuits) SU1–SUn which correspond to the respective data signal lines SL1–SLn and sample an image signal DAT at timings indicated by timing signals T1–Tn corresponding to the respective sampling units SU1–SUn. In the present embodiment, a sampling unit SUi is realized as an analog switch which is provided between a signal line for transmitting an image signal DAT and a data signal line SLi corresponding to the sampling unit SUi, and is switched in accordance with a timing signal Ti.

Further, to reduce the power consumption, the data signal line drive circuit 3 in accordance with the present embodiment includes: a scanning circuit section (scanning section) 12 including shift registers SRA and SRB belonging to respective systems being independent from each other; a switching section (switching means) 13 for generating the timing signals Ti–Tn in accordance with the output signals O1–On from the scanning circuit section 12 and the resolution switching signal MC; and a register control section (control means) 14 for controlling the operation/non-operation of the shift register SRB in accordance with the resolution switching signal MC. Here, in the case of FIG. 1, the shift register SRA corresponds to a second shift register in claims, and the shift register SRB corresponds to a first shift register in claims.

The shift register SRA is a shift register composed of p latch circuits LA1–LAp connected in a cascade manner, and the odd-number-th output signals O1, O3, . . . among the output signals O1–On can be outputted from the respective latch circuits LA1–LAp (output from each stage of the shift register SRA). Here, p is either n/2 where n is an even number or (n+1)/2 where n is an odd number.

The shift register SRB is a shift register composed of q latch circuits LB1–LBq connected in a cascade manner, and the even-number-th output signals O2, O4, . . . among the output signals O1–On can be outputted from the respective latch circuits LB1–LBq (output from each stage of the shift register SRB). Here, q is either n/2 where n is an even number or (n−1)/2 where n is an odd number.

Moreover, to each stage (latch circuits LA1–LAp) of the shift register SRA, a clock signal SCKA is supplied from the control circuit 6 illustrated in FIG. 2, and to each stage (latch circuits LB1–LBq) of the shift register SRB, a clock signal SCKB is supplied from the control circuit 6.

Moreover, to the first stage (latch circuit LA1) of the shift register SRA and the first stage (latch circuit LB1) of the shift register SRB, respective start pulse signals SSPA and SSPB are supplied from the control circuit 6.

In the arrangement above, two shift registers SRA and SRB of respective systems are provided, and driving of the data signal lines SL1–SLn can be shared by these shift registers SRA and SRB. Thus, the maximum drive frequency of the clock signals SCKA and SCKB is half as much as the maximum drive frequency in a below-mentioned arrangement in which a scanning circuit section 12*f* is composed of a shift register SR of a single system. Accordingly, the shift registers SRA and SRB are realized by circuits whose operating speed is slower than the operating speed in the arrangement in which the scanning circuit section 12*f* is composed of the shift register SR of a single system. Incidentally, two shift registers of respective systems are provided in the present embodiment, but the total sum of the number of stages of both registers is, as in the case of the single system, equivalent to the number of the data signal lines SL1–SLn (i.e. n stages). On this account, even if two shift registers SRA and SRB of respective systems are provided, the size of the circuit does not increase, since the total number of the stages remains unchanged. As a result, it is possible to reduce the power consumption for driving as well as the size of the scanning circuit section 12.

In contrast, the switching section 13 outputs the timing signals T1–Tn specified by the respective outputs O1–On from the scanning circuit section 12, when the resolution switching signal MC indicates that the resolution is high. Meanwhile, when low-resolution is indicated, provided that k is an integral number not more than p, generating timing signals T(2*k−1) and T(2*k) specified by an output O(2*k−1) enables to output the timing signals T1–Tn in accordance with the outputs O1–On from the respective stages of the shift register SRA.

More specifically, the switching section 13 is divided into p blocks B1–Bp, and each block Bk is provided with: a signal path from a k-th stage (latch circuit LAk) of the shift register SRA to a sampling unit SU(2*k−1); and a signal path from a k-th stage (latch circuit LBk) of the shift register SRB to the sampling unit SU(2*k). Moreover, each block Bk is provided with: a switch ASOk which interrupts the signal path from the latch circuit LBk to the sampling unit SU(2*k); and a switch ASNk which connects the signal path from the latch circuit LAk to the sampling unit SU(2*k), when low-resolution is indicated by the resolution switching signal MC. Here, when n is an odd number, in the last block Bp, it is unnecessary to provide a signal path from the shift register SRB to the sampling section 11 and switches ASNp and ASOp.

Further, in the present embodiment, (i) wave shaping circuits WE(2*k−1) and WE(2*k) for adjusting pulse widths of the respective signals supplied from the block Bk to the sampling units SU(2*k−1) and SU(2*k) and (ii) buffer circuits BF(2*k−1) and BF(2*k) for buffering the respective output signals from the wave shaping circuits WE(2*k−1) and WE(2*k) are provided between the block Bk and the corresponding sampling units SU(2*k−1) and SU(2*k), in order to improve the precision of sampling timings of the sampling units SU(2*k−1) and SU(2*k).

In this case, the switch ASOk is provided between the latch circuit LBk and the wave shaping circuit WE(2*k). Also, one terminal of the switch ASNk is connected to the latch circuit LAk, while the other terminal of the switch ASNk is connected to a node of the switch ASOk and the wave shaping circuit WE(2*k).

Figure 4:
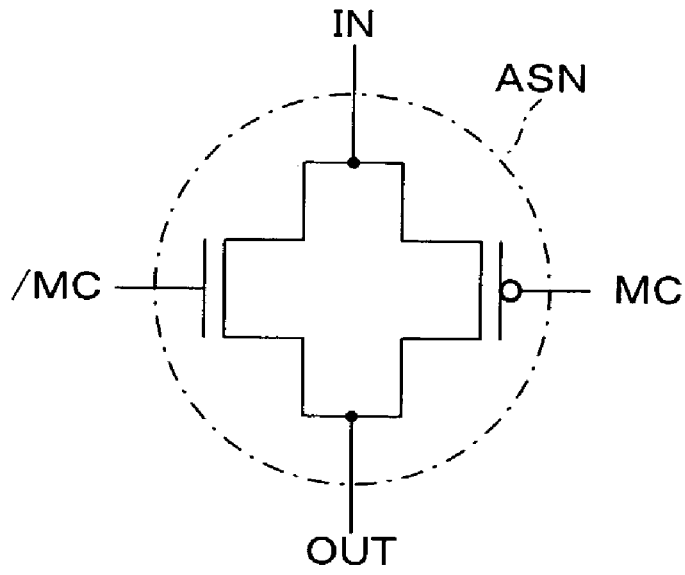
FIG. 4 is a circuit diagram, illustrating an example of a switch provided in the data signal line drive circuit.
Figure 5:
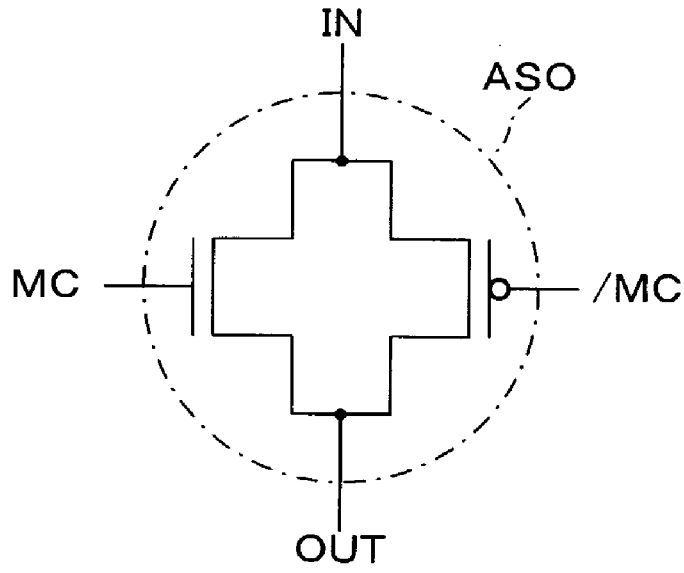
FIG. 5 is a circuit diagram, illustrating an example of another switch provided in the data signal line drive circuit.

As FIGS. 4 and 5 indicate, it is possible to realize the switches ASNk and ASOk as, for instance, a CMOS analog switch composed of an n-ch transistor and a p-ch transistor, respectively. For instance, when the resolution switching signal MC is low-level which indicates low-resolution, the gate of the p-ch transistor constituting the switch ASNk receives the signal MC which is positive phase, and the gate of the n-ch transistor receives a signal /MC which is negative phase and opposite to the signal MC. Similarly, the gate of the n-ch transistor constituting the switch ASOk receives the signal MC which is positive phase, and the gate of the p-ch transistor receives the signal /MC which is negative phase. Here, the signal /MC is generated by, for instance, inverting the signal MC using an inverter.

Figure 6:
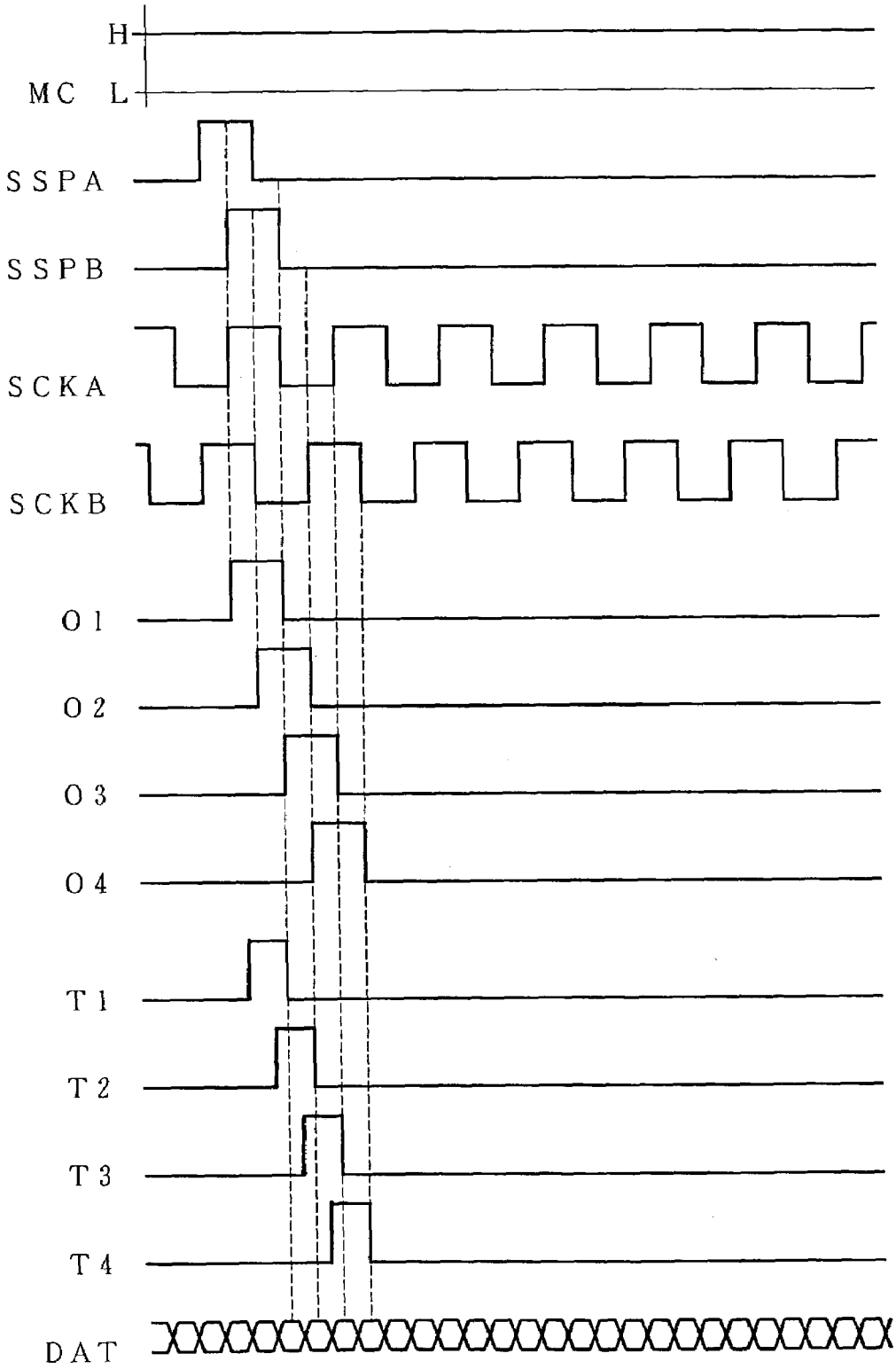
FIG. 6, showing the operation of the data signal line drive circuit, is a waveform chart illustrating signal waveforms of different sections, in high-resolution mode.

According to this arrangement, when an image signal DAT of high-resolution is inputted, as FIG. 6 illustrates, the control circuit 6 supplies a resolution switching signal MC indicating high-resolution (high-level, for instance) to the data signal line drive circuit 3.

In accordance with this, in the switching section 13 of the data signal line drive circuit 3, the switches ASO1–ASOp are brought into conduction, while the switches ASN1–ASNp are interrupted. In this state, (i) a signal path from a k-th stage (latch circuit LAk) of the shift register SRA to the sampling unit SU(2*k−1) and (ii) a signal path from a k-th stage (latch circuit LBk) of the shift register to the sampling unit SU(2*k) are available, and the data signal lines SL1–SLn are alternately allocated to the output from the shift register SRA and the output from the shift register SRB.

When the resolution switching signal MC indicates high-resolution, the register control section 14 is arranged in such a manner that the shift register SRB is operated by, for instance, supplying electric power to the shift register SRB. In the meantime, the control circuit 6 is arranged in such a manner that clock signals SCKA and SCKB, in which the frequency of a shift timing is half as much as the applied frequency of the image data D, are outputted, in order to operate the shift registers SRA and SRB. On this occasion, in the control circuit 6, the phase of the clock signal SCKA and the phase of the clock signal SCKB are arranged in such a manner that a shift timing of the shift register SRB, the timing instructed by a clock signal SCKB, is sandwiched by shift timings of the shift register SRA, the timings instructed by a clock signal SCKA, in order to write data (image data D supplied to the pixels PIX), each of the data being supplied at a different timing, into the data signal lines SL1–SLn.

In the present embodiment, the shift register SRA shifts at the both edges of the clock signal SCKA, and the shift register SRB shifts at the both edges of the clock signal SCKB. Thus, the frequencies of the respective clock signals SCKA and SCKB are a quarter of the applied frequency of the image data D, and the phase difference between the clock signals SCKA and SCKB is arranged so as to be 90°.

Moreover, the control circuit 6 supplies the start pulse signals SSPA and SSPB to the data signal line drive circuit 3, with the timing of causing the phase of the first-stage output O1 of the shift register SRA to be faster than the phase of first-stage output O2 by the aforementioned phase difference (in this example, 90° of the clock signal SCKA).

Thus, as O1–O4 in FIG. 6 indicate, the waveform of an output Oi from the scanning circuit section 12 has a timing slower than the waveform of the previous output O(i−1) by the aforementioned phase difference (in this example, 90° of the clock signal SCKA). Also, as described above, when the resolution switching signal MC indicates high-resolution, the signal path from a k-th stage (latch circuit LAk) of the shift register SRA to a sampling unit SU(2*k−1) and the signal path from a k-th stage (latch circuit LBk) of the shift register SRB to the sampling unit SU(2*k) are available in each block Bk. Thus, the output Oi is subjected to the adjustment of its pulse width in a corresponding wave shaping circuit WEi, and then subjected to the buffering in a buffer circuit BFi, so as to be outputted to a sampling unit SUi.

Here, the wave shaping circuit WEi and the buffer circuit BFi only carry out the adjustment of pulse width and the buffering, respectively. Thus, the phase difference between the output signal Ti of the buffer circuit BFi and the output signal T(i−1) of the previous buffer circuit BF(i−1) is equal to the phase difference in the scanning circuit section 12 (in this example, 90° of the clock signal SCKA), and this enables the buffer circuits BF1–BFn to output the respective timing signals T1–Tn, each having different sampling timing, to the sampling section 11.

For this reason, apparent signal line resolution of the sampling section 11 is identical with the actual signal line resolution so as to be n, and this enables the sampling units SU1–SUn of the sampling section 11 to sample the image signal DAT at each different timing and to output the respective sampling results (D(1, j)–D(n, j)) to the respective data signal lines SL1–SLn. On this account, the image data D(1, j)–D(n, j) are sampled from the image signal DAT whose signal line resolution is n, and it is also possible to output the sampling results (D(1, j)–D(n, j)) to the respective data signal lines SL1–SLn. In this case, since the sampling units SU1–SUn are individually driven at each different timing, the horizontal resolution of an image displayed by the image display device 1 is identical with the actual signal line resolution of the data signal line drive circuit 3 so as to be equal to the number of the data signal lines SL1–SLn, i.e. n.

Incidentally, the present embodiment is an example of adopting point-sequential drive, so that a sampling unit SUi of the sampling section 11 is brought into conduction during a period specified by a timing signal Ti. Thus, a point when the timing signal Ti is changed so as to have a value of indicating the shutoff is the sampling timing, and the value (image data D) of the image signal DAT at this point is supplied to a data signal line SLi as a sampling result.

Figure 7:
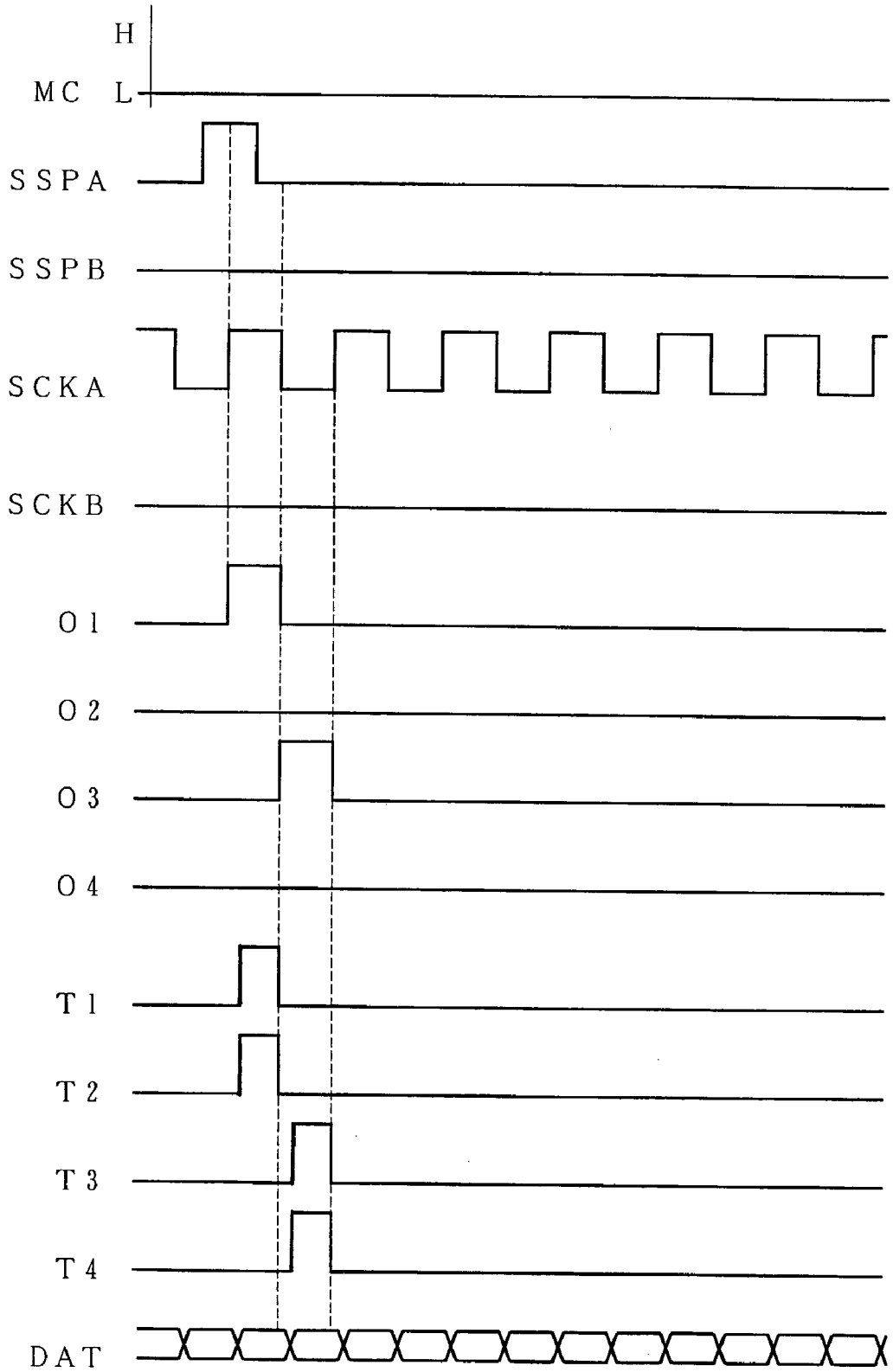
FIG. 7, showing the operation of the data signal line drive circuit, is a waveform chart illustrating signal waveforms of different sections, in low-resolution mode.

In contrast, when an image signal DAT of low-resolution is inputted, as FIG. 7 illustrates, the control circuit 6 supplies a resolution switching signal MC indicating low-resolution (e.g. a signal of low-level) to the data signal line drive circuit 3.

In accordance with this, the switches ASO1–ASOp are shut off whereas the switches ASN1–ASNp are brought into conduction in the switching section 13. In this state, signal paths from the k-th stage (latch circuit LAk) of the shift register SRA to the respective sampling units SU(2*k−1) and SU(2*k) becomes available, and two neighboring data signal lines SL are allocated to the shift register SRA as a single set.

Moreover, the control circuit 6 causes the start pulse signal SSPB, which is supplied to the shift register SRB, to be fixed at low-level, so that the shift register SRB becomes in the state of non-operation. In addition, when the resolution switching signal MC indicates low-resolution, the register control section 14 stops the operation of the shift register SRB by, for instance, cutting off the power supply to the shift register SRB. On this account, it is possible to reduce the power consumption of the shift register SRB in the state of non-operation.

Also, the control circuit 6 fixes the electric potential of the clock signal SCKB, which is supplied to the shift register SRB, at a constant value, and this makes it possible to reduce the power consumption of a circuit generating the clock signals SCK, such as the control circuit 6.

In addition, the control circuit 6 outputs the start pulse signal SSPA as well as the clock signal SCKA in which the frequency of its shift timing is identical with the applied frequency of the image data D, in order to drive the shift register SRA. Incidentally, since the shifting is carried out at the both edges of the clock signal SCKA, the frequency of the clock signal SCKA is half as much as the applied frequency of the image data D.

Thus, as indicated by O1–O4 in FIG. 7, the waveform of the output signal O(2*k−1), which is outputted from each latch circuit LAk of the shift register SRA of the scanning circuit section 12, has a timing slower than a timing of the waveform of the output signal O(2*k−3) of the latch circuit LA(k−1) which is the previous stage, by a shift distance of the shift register SRA (in this case, 180° of the clock signal SCKA). In the figure, since the shift register SRB is in the state of non-operation, the outputs O2 and O4 of the respective stages of the shift register SRB have a fixed value (low-level).

Also, as in the foregoing description, when the resolution switching signal MC indicates low-resolution, signal paths from the k-th stage (latch circuit LAk) of the shift register SRA to the respective sampling units SU(2*k−1) and SU(2*k) is available in each block Bk. The output O(2*k−1) is supplied to the sampling unit SU(2*k−1) as a timing signal T(2*k−1), via the wave shaping circuit WE(2*k−1) and the buffer circuit BF(2*k−1), and also the output O(2*k−1) is supplied to the sampling unit SU(2*k) as a timing signal T(2*k), via the wave shaping circuit WE(2*k) and the buffer circuit BF(2*k).

Also in this case, a wave shaping circuit WEi and a buffer circuit BFi only carry out the adjustment of pulse width and the buffering, respectively. Thus, the phase difference between the output signal T(2*k−1) from the buffer circuit BF(2*k−1) and the output signal T(2*k−3) from the buffer circuit BF(2*k−3) is equivalent to the shift distance of the shift register SRA (in this example, 180° of the clock signal SCKA), as in the case of the phase difference between the output signal O(2*k−1) and the output (2*k−3) in the shift register SRA. Moreover, to the neighboring sampling units SU(2*k−1) and SU(2*k), respective timing signals T(2*k−1) and T(2*k), both indicating the sampling at an identical timing, are supplied.

Thus, apparent signal line resolution of the sampling section 11 is p(n/2 or (n+1)/2), and among the sampling units SU1–SUn of the sampling section 11, two groups each composed of the neighboring sampling units SU(2*k−1) and SU(2*k) sample the image signal DAT at each different timing, whereas the neighboring sampling units SU(2*k−1) and SU(2*k) sample the image signal DAT at an identical timing. For this reason, the image data D(1, j)–D(p, j) are sampled from the image signal DAT of the signal line resolution p, and during the selection of the scanning signal line GLj, the sampling results (D(1, j)–D(p, j)) are supplied to the respective data signal lines SL1–SLn.

According to the foregoing arrangement, the shift registers SRA and SRB, which are independent from each other and each belongs to a different system, are provided in order to generate the timing signals T1–Tn supplied to the respective sampling units SU1–SUn. Moreover, on the occasion of low-resolution, the output from each stage of the shift register SRA, the shift register SRA being one of the two shift registers, is supplied to a plurality of sampling units SU, and this makes it possible to generate the timing signals T1–Tn supplied to the respective sampling units SU1–SUn, only in accordance with the outputs from the shift register SRA, and stop the operation of the shift register SRB which is the other one of the two shift registers.

On this account, compared to the arrangement in which a scanning circuit section (scanning section) is composed of a shift register SR of a single system and this shift register SR outputs output signals O1–On regardless of the resolution and timing signals T1–Tn are generated in accordance with the output signals O1–On, the drive frequencies of the respective shift registers SRA and SRB can be halved regardless of the signal line resolution, and the number of the stages of the shift register SRA, the stages operating on the occasion of low-resolution, can be also halved. Moreover, according to the present embodiment, the drive frequency of the shift register SRA which operates on the occasion of low-resolution is reduced to ½, even in the case of high-resolution. For this reason, the maximum frequency of the respective latch circuits LA1–LAp constituting the respective stages of the shift register SRA is reduced to ½, so that the latch circuits LA1–LAp can be realized by slower circuits.

As a result, it is possible to reduce the power consumption of the data signal line drive circuit 3 to be significantly lower than the power consumption in the foregoing arrangement, for instance, to be not more than ¼ of the power consumption in the foregoing arrangement. Moreover, since the maximum drive frequency is low, it is possible to reduce the size of the circuit and the power consumption.

Moreover, in the present embodiment, since the power supply to the shift register SRB has been stopped on the occasion of the input of the image signal DAT of low-resolution, it is possible to reduce the power consumption of the shift register SRB in the state of non-operation. In this case, since the output from each stage of the shift register SRA is supplied to a plurality of sampling units SU, it is possible to generate the timing signals T1–Tn without hindrance. Further, in the present embodiment, on the occasion of low-resolution, the electric potential of the clock signal SCKB is kept at a constant value and not varied in accordance with a clock cycle, so that the power consumption of an external circuit (such as the control circuit 6) for generating the clock signal SCKB can be reduced too. Moreover, since it is possible to set the frequency of the image signal DAT of low-resolution to be lower than the frequency of the image signal DAT of high-resolution, the power consumption of a circuit for generating the image signal DAT (such as the control circuit 6) can be further reduced.

Figure 8:
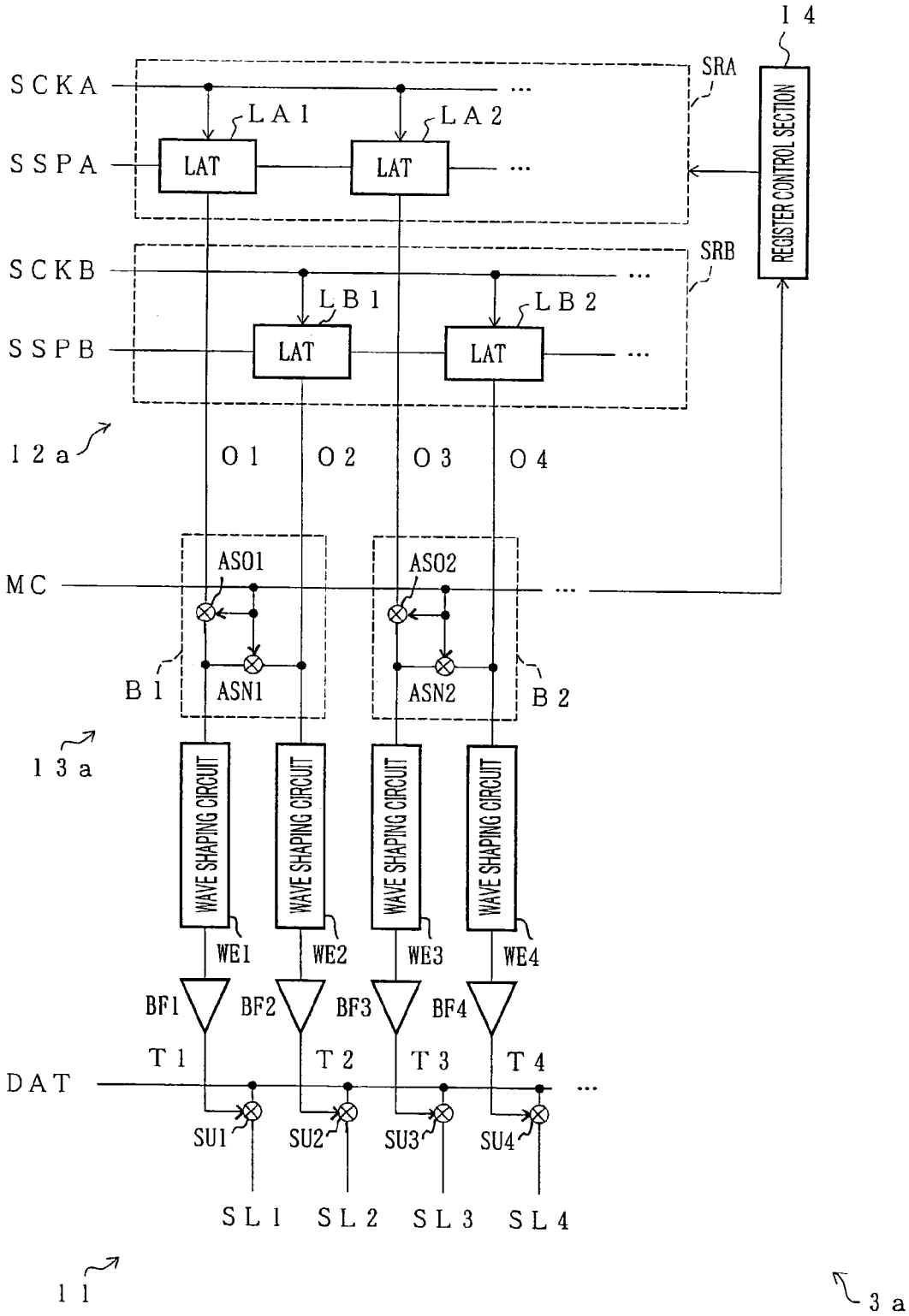
FIG. 8 is a block diagram, illustrating an alternative example of the data signal line drive circuit.

Although the foregoing descriptions discuss the case of using the shift register SRA on the occasion when the image signal DAT of low-resolution is inputted, a shift register SRB may be used, as in a data signal line drive circuit 3*a* illustrated in FIG. 8. In this arrangement, the shift register SRA corresponds to a first shift register in claims, and the shift register SRB corresponds to a second shift register in claims.

According to this arrangement, in each block Bk of a switching section 13*a*, a switch ASOk, which is shut off on the occasion when a resolution switching signal MC indicates low-resolution, is provided on a signal path from a k-th latch circuit LAk of the shift register SRA to a sampling unit SU(2*k−1). Also, a switch ASNk connects a signal path from a k-th latch circuit LBk of the shift register SRB with a signal path from the sampling unit SU(2*k−1). Further, a register control section 14 determines the operation/non-operation of the shift register SRA by whether or not an image signal DAT is of high-resolution, rather than the operation/non-operation of the shift register SRB.

No matter which one of the shift registers SRA and SRB is driven on the occasion of low-resolution, the data signal line drive circuit 3 (3*a*) with the foregoing arrangement adopts two shift registers SRA and SRB of respective systems on the occasion of high signal line resolution, so that the image signal DAT of high-resolution can be properly sampled while restraining the drive frequencies of the respective shift registers SRA and SRB to be low. Further, using one of the shift registers SRA and SRB which are (i) optimized for the low drive frequency, (ii) small in size, and (iii) low-power consumption type, an image signal DAT of low-resolution is sampled. On this account, it is possible to realize the data signal line drive circuit 3 (3*a*) which is capable of driving data signal lines SL1–SLn with low power consumption as well as changing apparent signal line resolution in accordance with the signal line resolution of the image signal DAT.

Incidentally, the pixel array 2, the data signal line drive circuit 3 (3*a*–3*d*), and the scanning signal line drive circuit 4, which are illustrated in FIG. 2, may be individually formed and then connected with each other by, for instance, connecting the substrates on which the respective members are formed. However, if the reduction of manufacturing costs or mounting costs of the drive circuits is required, it is preferable that the pixel array 2, the drive circuits 3 (3*a*–3*d*), and 4 are formed on the same substrate, i.e. monolithically formed. With this arrangement, it is unnecessary to connect these members after they are formed, so that the reliabilities can be improved. By the way, in FIG. 2, members formed on the same substrate are circumscribed by a broken line.

Now, as an example of the monolithically-formed image display device 1, the following descriptions will briefly discuss an arrangement of a polycrystalline silicon thin-film transistor and a manufacturing method thereof, on the occasion when the pixel array 2 and the drive circuits 3 (3*a*–3*d*) and 4, which are active elements, are constituted by the polycrystalline silicon thin-film transistor.

Figure 9:
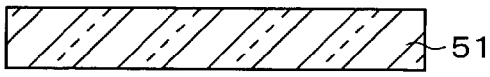
FIGS. 9(*a*)–9(*k*) indicate manufacturing steps of a thin-film transistor constituting the image display device, and are process cross sections showing the cross section of a substrate in each step.
Figure 9:
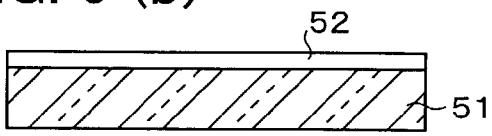
Figure 9:
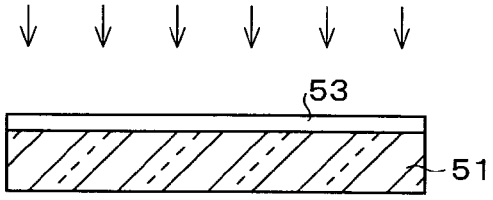
Figure 9:
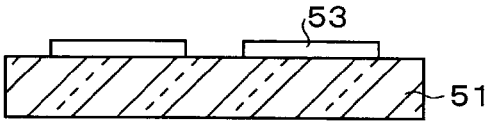
Figure 9:
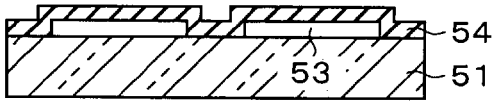
Figure 9:
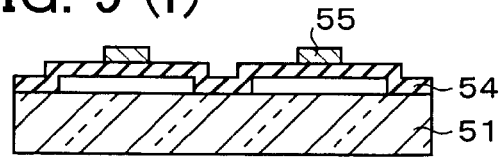
Figure 9:
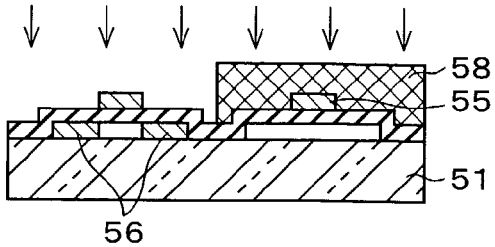
Figure 9:
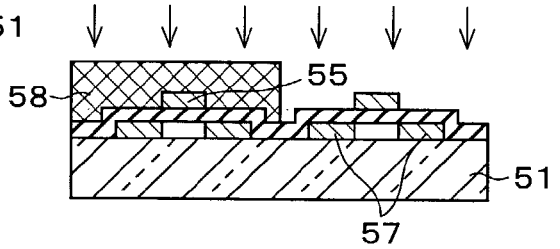
Figure 9:
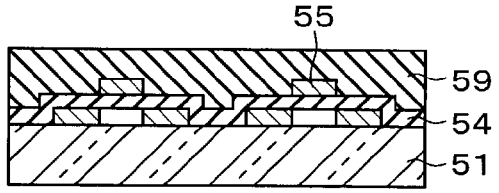
Figure 9:
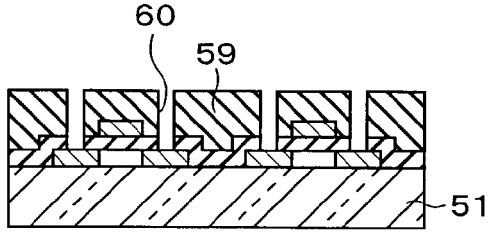
Figure 9:
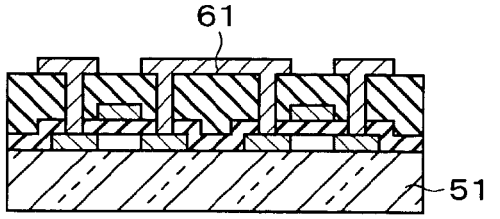

That is, on a glass substrate 51 illustrated in FIG. 9(*a*), an amorphous silicon thin film 52 is deposited, as in FIG. 9(*b*). Then, as illustrated in FIG. 9(*c*), an excimer laser is projected on the amorphous silicon thin film 52 so that the film 52 is altered to be a polycrystalline silicon thin film 53.

Then, as illustrated in FIG. 9(*d*), the polycrystalline silicon thin film 53 is subjected to patterning so as to be formed as a desired shape, and as illustrated in FIG. 9(*e*), a gate insulating film 54 made of silicon dioxide is formed on the polycrystalline silicon thin film 53.

Then, after a gate electrode 55 of a thin-film transistor is formed on the gate insulating film 54 using aluminum, etc. as illustrated in FIG. 9(*f*), impurities are doped to areas 56 and 57 respectively to be a source area and a drain area of the thin-film transistor, as illustrated in FIGS. 9(*g*) and 9(*h*). Here, phosphor is doped to the n-type area 56 and boron is doped to the p-type area 57. Before doping the impurity to either one of the areas, the remaining area is covered with a resist 58, so that it is possible to dope the impurity solely to the desired area.

Then, as illustrated in FIG. 9(*i*), an interlayer insulating film 59 made of silicon dioxide or silicon nitride is deposited on the gate insulating film 54 and the gate electrode 55, and after a contact hole 60 is formed as illustrated in FIG. 9(*j*), a metal wiring 61 made of aluminum, etc. is formed, as illustrated in FIG. 9(*k*).

Figure 10:
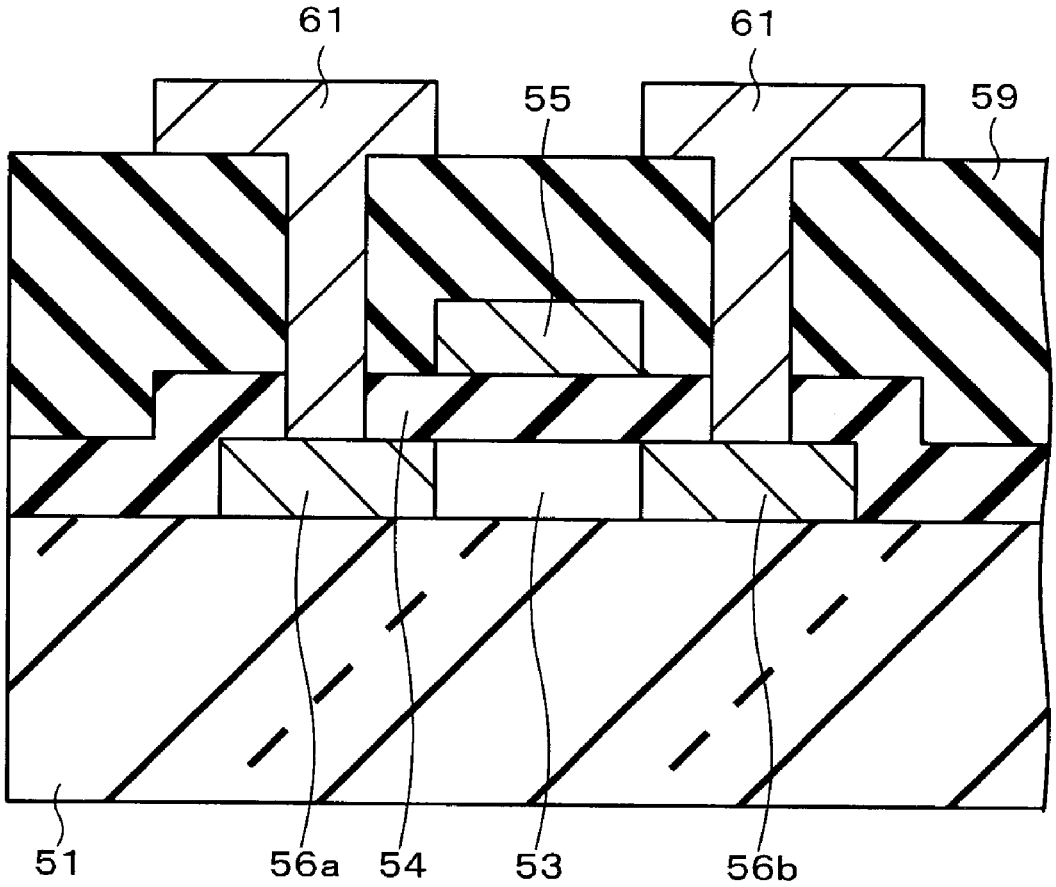
FIG. 10 is a cross section, illustrating an arrangement of the thin-film transistor.

As a result, a thin-film transistor, having a forward stagger (top gate) arrangement in which a polycrystalline silicon thin film on an insulating substrate is an active layer, is formed, as illustrated in FIG. 10. Here, the figure shows an example of an n-ch transistor, so that the n-type area 56 is divided into areas 56*a* and 56*b* sandwiching the polycrystalline thin film 53, which is below the gate electrode 55, in the direction parallel to the surface of the glass substrate 51, and one of the areas 56*a* and 56*b* is a source area, and the other is a drain area.

In this manner, using a polycrystalline thin-film transistor, it is possible to form a data signal line drive circuit 3 (3*a*–3*d*) and a scanning signal line drive circuit 4, both having practical ability of driving, on the substrate on which a pixel array is formed, with manufacturing steps substantially identical with those of the pixel array. Although the foregoing description takes a thin-film transistor with this arrangement as an example, It is possible to acquire substantially the same effects by, for instance, adopting polycrystalline thin-film transistors with other arrangements such as an inverse stagger arrangement.

Here, in the steps illustrated in FIGS. 9(*a*)–9(*k*), the maximum temperature is 600° C. on the occasion of forming the gate insulating film, so that, for instance, it is possible to adopt a high-heat-resisting glass such as Corning® 1737 glass manufactured by Corning Inc. as the substrate 51.

As described above, forming a polycrystalline silicon thin-film transistor at a temperature not more than 600° C. makes it possible to adopt a low-cost and large-size glass substrate as an insulating substrate. As a result, it is possible to realize an image display device 1 which is cheap but has a large display area.

As a polycrystalline silicon thin-film, it is possible to adopt a film whose crystallization is accelerated by at least one element selected from the group consisting of Ni, Fe, Co, Sn, Pb, Ru, Rh, Pd, Os, Ir, Pt, Cu, and Au, and this results in obtaining good crystallizability and electrical characteristics.

Incidentally, when the image display device 1 is a liquid crystal display device, a transmissive electrode (in the case of transmissive liquid crystal display devices) or a reflective electrode (in the case of reflective liquid crystal display devices) is additionally formed via an another interlayer insulating film.

[Second Embodiment]

In this embodiment, an arrangement in which the signal line resolution is n or n/3 will be described, as an example of a case when the ratio of the signal line resolution on the occasion of high-resolution to the signal line resolution on the occasion of low-resolution is different from the aforementioned value.

Figure 11:
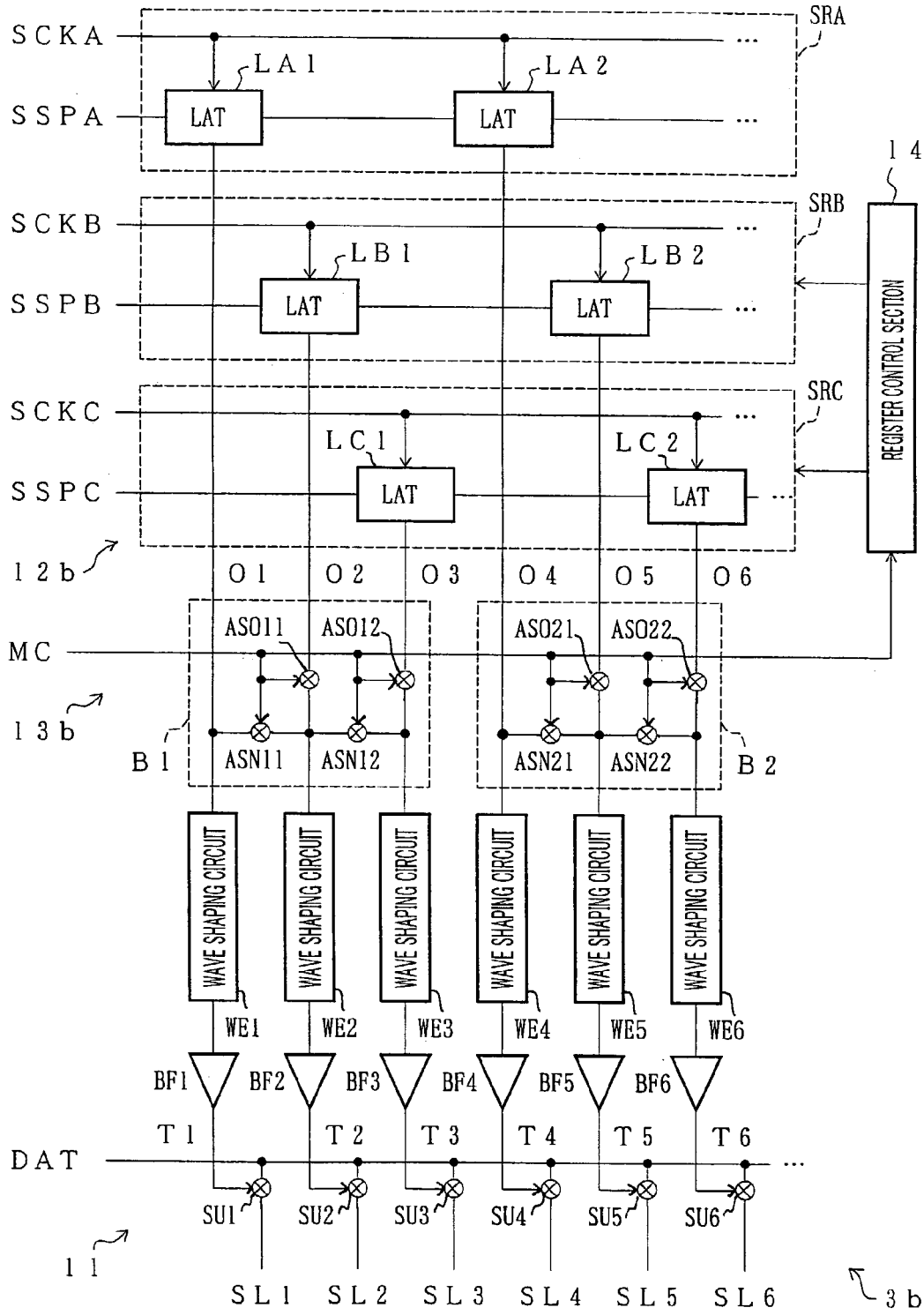
FIG. 11 is a block diagram related to another embodiment in accordance with the present invention, illustrating an arrangement of a substantial part of a data signal line drive circuit.

That is to say, in the present embodiment, due to the alteration of the ratio from 2:1 to 3:1, three shift registers SRA, SRB, and SRC of respective systems are provided in a scanning circuit section 12*b* of a data signal line drive circuit 3*b* are provided, as illustrated in FIG. 11. By the way, in the arrangement illustrated in FIG. 11, the shift register SRA corresponds to a second shift register of claims, and the shift registers SRB and SRC correspond to a first shift register of claims.

Because of this alteration of the arrangement, the respective shift registers SRA–SRC have p, q, and r stages, and the number of stages of each of the shift registers SRA–SRC is fewer than the number of stages in the-case of adopting two systems. Here, p is either a quotient of n/3 where n is multiples of 3 or the quotient plus 1 where n is not multiples of 3. q and r are either the quotient or the quotient plus 1, and p+q+r=n.

Moreover, in the present embodiment, data signal lines SL1–SLn are arranged so as to be capable of being sequentially allocated to the outputs from the shift registers SRA–SRC. More specifically, the outputs from the respective stages of the shift register SRA, i.e. the outputs from latch circuits LA1–LAp are outputted as ((multiples of 3)+1)-th output signals O1, O4, among the output signals O1–On of the scanning circuit section 12*b*. Similarly, the outputs from the respective stages of the shift register SRB (outputs from latch circuits LB1–LBq) are outputted as ((multiples of 3)+2)-th output signals O2, O5, among the output signals O1–On of the scanning circuit section 12*b*, and the outputs from the respective stages of the shift register SRC (outputs from latch circuits LC1–LCr) are outputted as (multiples of 3)-th output signals O3, O6, among the output signals O1–On of the scanning circuit section 12*b*.

Furthermore, the switching section 13*b* in accordance with the present embodiment is arranged in such a manner that an output from each stage of one of the shift registers (SRA in the arrangement in FIG. 11) is supplied to three sampling units SU, on the occasion of low-resolution.

More specifically, the switching section 13*b* is divided into p blocks B1–Bp. When an integral number not more than p is k, each block Bk is provided with three signal paths-from outputs O(3*k−2) and O(3*k−1) of k-th stages of the respective shift registers SRA–SRC to respective sampling units SU(3*k−2), SU(3*k−1), and SU(3*k), as in the arrangement with two systems.

Moreover, each block Bk is further provided with: switches ASOk1 and ASOK2 which interrupt respective signal paths from the non-operating shift registers SRB and SRC to the respective sampling units SU(3*k−1) and SU(3*k), when a resolution switching signal MC indicates low-resolution; and switches ASNk1 and ASNk2 which connect respective signal paths from the non-operating shift registers SRB and SRC with corresponding signal paths from the respective sampling units SU(3*k−1) and SU(3*k).

Here, being substantially identical with First Embodiment, when n is not multiples of 3, it is unnecessary to provide (i) signal paths from the shift registers SRB and SRC to a sampling section 11 and (ii) the switches ASNp2, ASOp2, ASNp1, and ASOp1, in the last block Bk.

Further, as in the arrangement in FIG. 1, the block Bk in accordance with the present embodiment is provided with: wave shaping circuits WE(3*k−2), WE(3*k−1), and WE(3*k) for adjusting the pulse widths of respective signals from the latch circuits LAk-LCk; and buffer circuits BF(3*k−2), BF(3*k−1), and BF(3*k) for buffering the output signals from the respective wave shaping circuits WE(3*k−2), WE(3*k−1), and WE(3*k).

Figure 12:
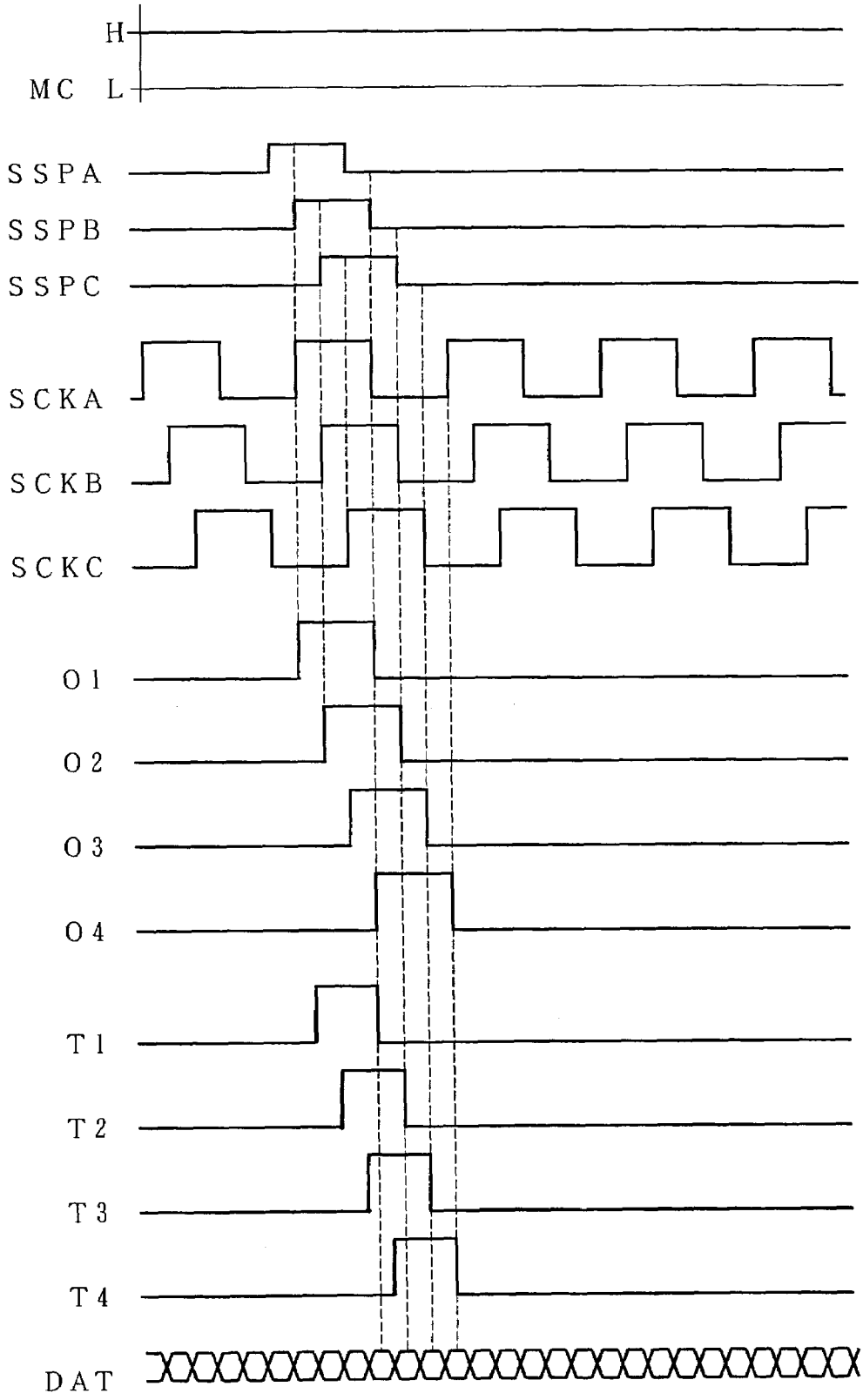
FIG. 12, showing the operation of the data signal line drive circuit, is a waveform chart illustrating signal waveforms of different sections, in high-resolution mode.

According to this arrangement, when an image signal DAT of high-resolution is supplied, a control circuit 6*b* supplies a resolution switching signal MC indicating high-resolution (the signal is in a high-level, for instance) to the data signal line drive circuit 3*b*, as illustrated in FIG. 12.

In accordance with this, in the switching section 13*b* of the data signal line drive circuit 3*b*, switches ASO11–ASOp1 and switches ASO12–ASOp2 are brought into conduction, while switches ASN11–ASNp1 and switches ASN12–ASNp2 are shut off. For this reason, the data signal line SL1–SLn are sequentially allocated to the outputs from the shift registers SRA–SRC.

When the resolution switching signal MC indicates high-resolution, the register control section 14 puts the shift registers SRB and SRC into operation by, for instance, supplying electric power to the shift registers SRB and SRC. In the meantime, the control circuit 6*b* outputs clock signals SCKA, SCKB, and SCKC in which the frequency of a shift timing is ⅓ of the applied frequency of the image data D, in order to drive all shift registers SRA–SRC. On this occasion, the control circuit 6*b* is arranged in such a manner that, in order to write data (image data D to the pixels PIX) into the respective data signal lines SL1–SLn at each different point of time, the phase of the clock signals SCKA–SCKC is arranged such as the shift timings of the shift registers SRA–SRC specified by the respective clock signals SCKA–SCKC are repeated in the order of the data signal lines SL1–SLn corresponding to the shift registers SRA–SRC (in this case, the order as SCKA→SCKB→SCKC→SCKA).

In the present embodiment, the shift registers SRA–SRC are arranged so as to be-shifted at both edges of the clock signals SCKA–SCKC. Thus, the frequency of the clock signals SCKA–SCKC is ⅙ of the applied frequency of the image data D, and phase differences between the clock signals SCKA and SCKB, SCKB and SCKC, and SCKC and SCKA are arranged so as to be 60°.

Further, the control circuit 6*b* supplies start pulse signals SSPA–SSPC to the shift registers SRA–SRC, in order to cause the phase differences of the outputs O1–OC from the first stages of the respective shift registers SRA–SRC to be different from each other by the above-mentioned phase difference.

With this arrangement, as illustrated in FIG. 12, (i) the phase difference between the waveform of an output Oi from the scanning circuit section 12*b* and the waveform of the previous output O(i−1) from the scanning circuit section 12*b* and (ii) the phase difference between the waveform of an output signal Ti from a buffer circuit BFi and the waveform of an output signal T(i−1) from the previous buffer circuit BF(i−1) are arranged so as to be equivalent to the aforementioned phase difference. For this reason, buffer circuits BF1–BFn can output respective timing signals T1–Tn to the sampling section 11 at each different sampling timing.

Thus, as in First Embodiment, apparent signal line resolution of the sampling section 11 is n, so that the sampling units SU1–SUn of the sampling section 11 can sample the respective image signals DAT at each different timing. On this account, image data D(1, j)–D(n, j) are sampled from the respective image signals DAT with the signal line resolution of n, and during the selection of a scanning signal line GLj, sampling results (D(1, j)–D(n, j)) can be outputted to the respective data signal lines SL1–SLn.

Figure 13:
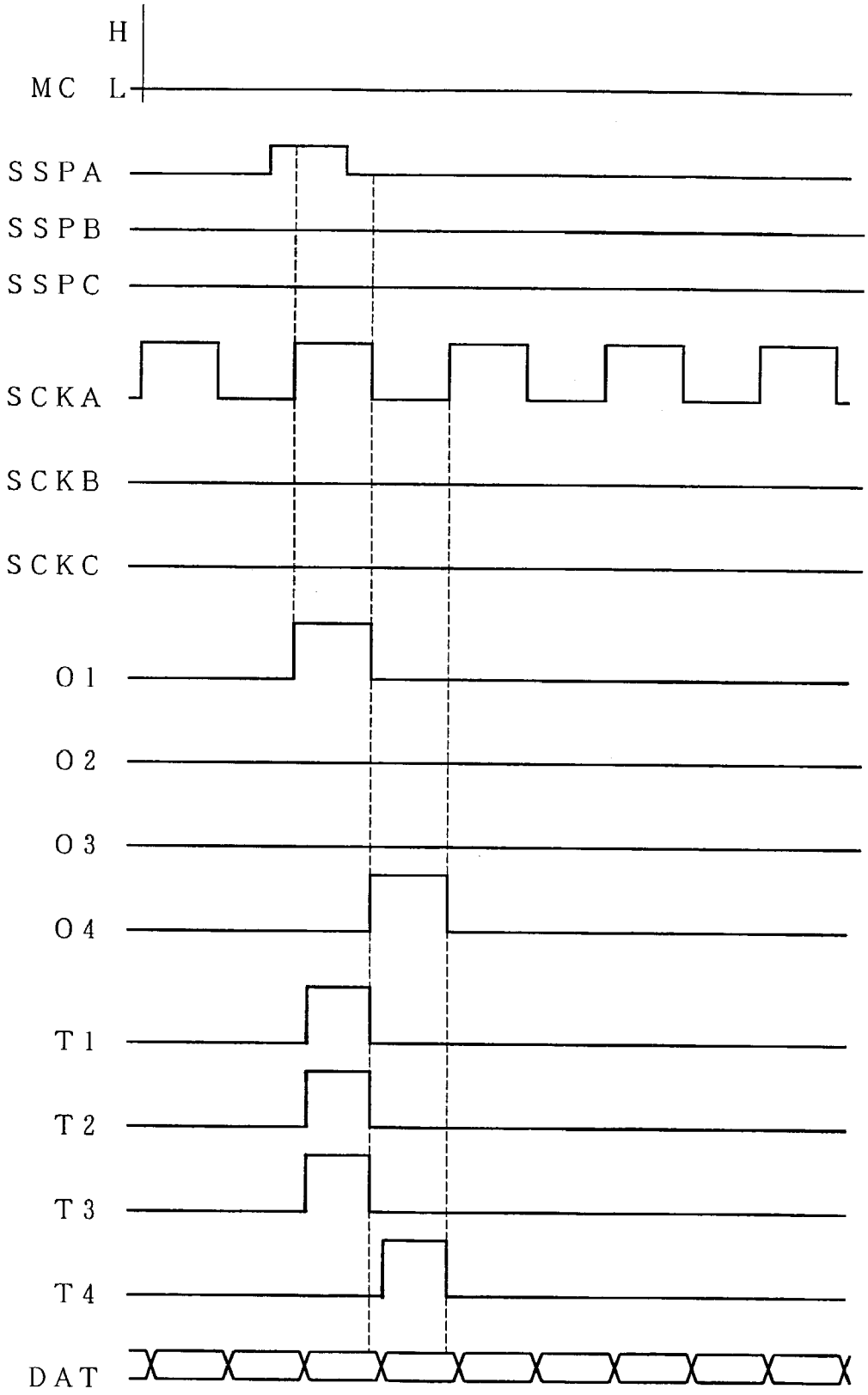
FIG. 13, showing the operation of the data signal line drive circuit, is a waveform chart illustrating signal waveforms of different sections, in low-resolution mode.

In the meantime, when the image signal DAT of low-resolution is inputted, as FIG. 13 illustrates, the control circuit 6*b* supplies a resolution switching signal MC indicating low-resolution (the signal is, for instance, in the low-level) to the data signal line drive circuit 3*b*.

In accordance with this, in the switching section 13*b*, the switches ASO11–ASOp1 and the switches ASO12–ASOp2 are shut off, while the switches ASN11–ASNp1 and the switches ASN12–ASNp2 are brought into conduction. On this occasion, signal paths from a k-th stage (latch circuit LAk) of the shift register SRA to respective sampling units SU(3*k−2), SU(3*k−1), and SU(3*k) become available, so that, as a single set, three neighboring data signal lines SL are allocated to the shift register SRA.

Further, the control circuit 6*b* causes the start pulse signals SSPB and SSPC, which are supplied to the shift registers SRB and SRC, to be fixed at low-level, so as to cause the shift registers SRB and SRC, which are arranged to be stopped on the occasion of low-resolution, to be stopped. In addition, when the resolution switching signal MC indicates low-resolution, for instance, the register control section 14 cut off the power supply to the shift registers SRB and SRC. Consequently, it is possible to reduce the power consumption of the shift registers SRB and SRC in the state of non-operation.

Moreover, by the control circuit 6*b*, the clock signals SCKB and SCKC supplied to the respective shift registers SRB and SRC are fixed at constant electric potentials. This enables to, for instance, reduce the power consumption of a circuit generating clock signals, such as the control circuit 6*b*.

Also, the control circuit 6*b* outputs (i) a clock signal SCKA in which the frequency of a shift timing is identical with the applied frequency of the image data D and (ii) a start pulse signal SSPA, in order to drive the shift register SRA. By the way, since the shifting is carried out at both edges in the present embodiment, the frequency of the clock signal SCKA is half as much as the applied frequency of the image data D.

Thus, as O1–O4 in FIG. 13 indicate, the waveform of an output signal O(3*k−2) from a latch circuit LAk of the shift register SRA of the scanning circuit section 12*b* has a timing slower than a timing of the waveform of an output signal O(3*k−5) of the previous latch circuit LA(k−1) by the shift distance of the shift register SRA (in this example, by 180° of the clock signal SCKA). Here, since the shift registers SRB and SRC are in the state of non-operation, the output from each stage of the shift register SRB is at a constant value (low-level in the example in FIG. 13).

Moreover, as in First Embodiment, a wave shaping circuit WEi and a buffer circuit BFi of the present embodiment only carry out the adjustment of pulse width and the buffering, respectively. Thus, buffer circuits BF(3*k−2)–BF(3*k), corresponding to the k-th stage latch circuit LAk, output respective output signals Ti(3*k−2)–Ti(3*k) having an identical sampling timing. Also, the phase difference between (i) the output signals Ti(3*k−2)–Ti(3*k) and (ii) respective output signals Ti(3*k−5)–Ti(3*k−3), outputted from respective buffer circuits BF(3*k−5)–BF(3*k−3) corresponding to the latch circuit LA(k−1) which is one stage before the k-th stage latch circuit LAk, is equivalent to the phase difference between the output signal O(3*k−5) and the output signal O(3*k−2), both being outputted from the shift register SRA, i.e. equal to the shift distance of the shift register SRA (in this example, 180° of the clock signal SCKA).

On this account, apparent signal line resolution of the sampling section 11 is p, and among the sampling units SU1–SUn of the sampling section 11, two groups of the sampling units each composed of three neighboring sampling units SU(3*k−2)–SU(3*k) sample the image signal DAT at different timings, while three neighboring sampling units SU(3*k−2)–SU(3*k) sample the image signal DAT at an identical timing. For this reason, image data D(1, j)–D(n, j) are sampled from the respective image signals DAT with the signal line resolution of p, and during the selection of a scanning signal line GLj, sampling results (D(1, j)–D(n, j)) can be outputted to the respective data signal lines SL1–SLn.

Figure 14:
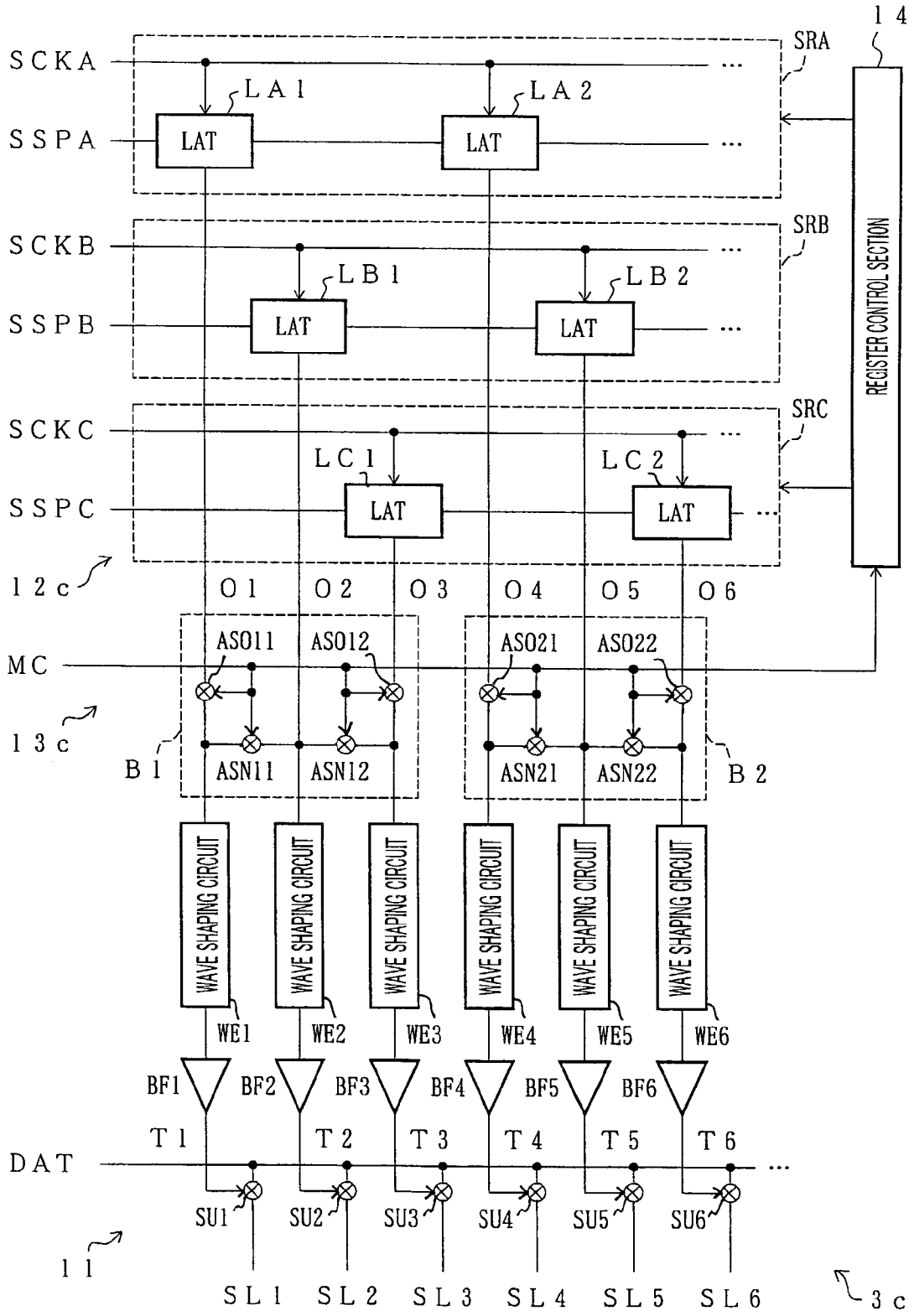
FIG. 14 is a block diagram, illustrating an alternative example of the data signal line drive circuit.
Figure 15:
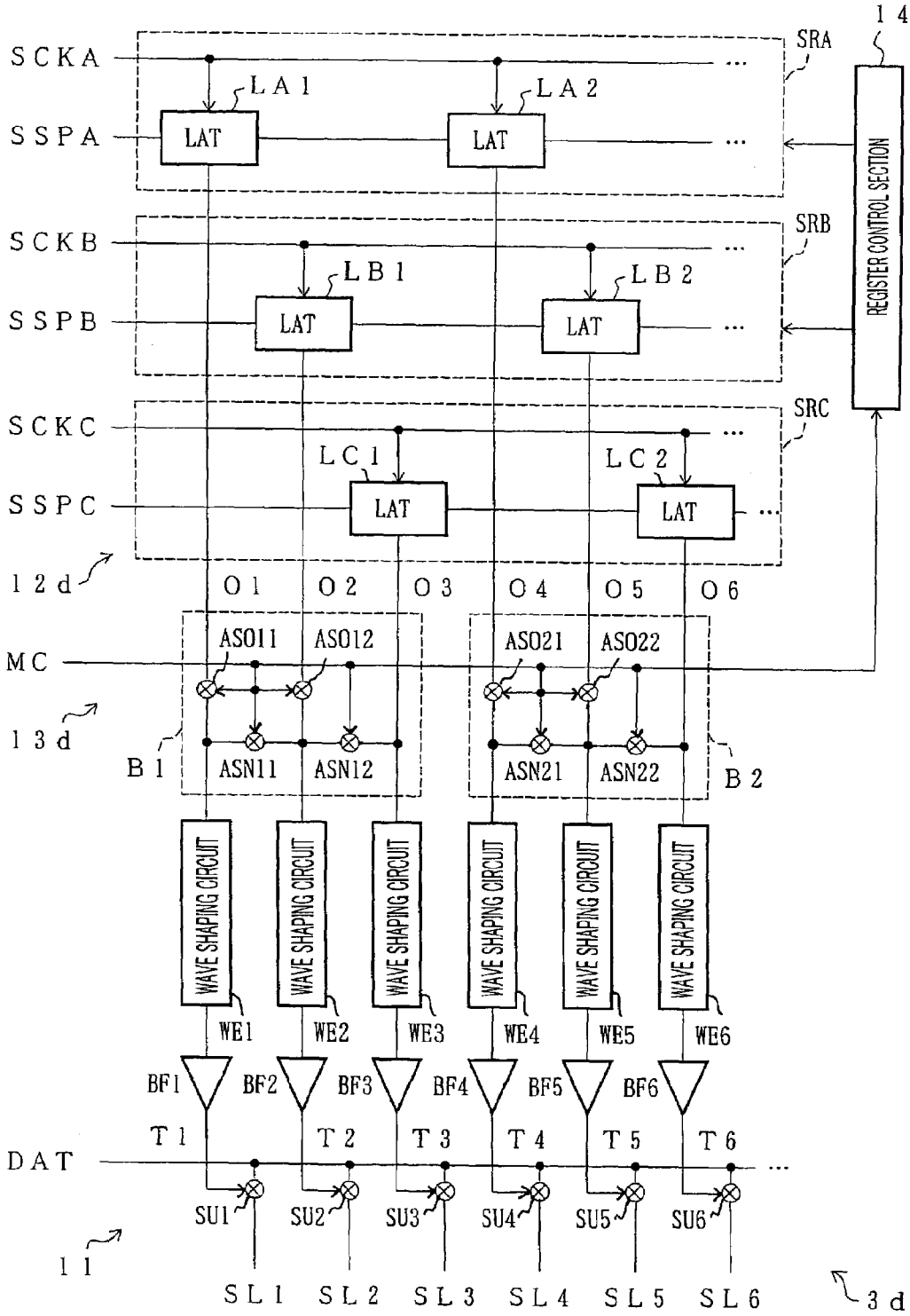
FIG. 15 is a block diagram, illustrating another alternative example of the data signal line drive circuit.
Figure 16:
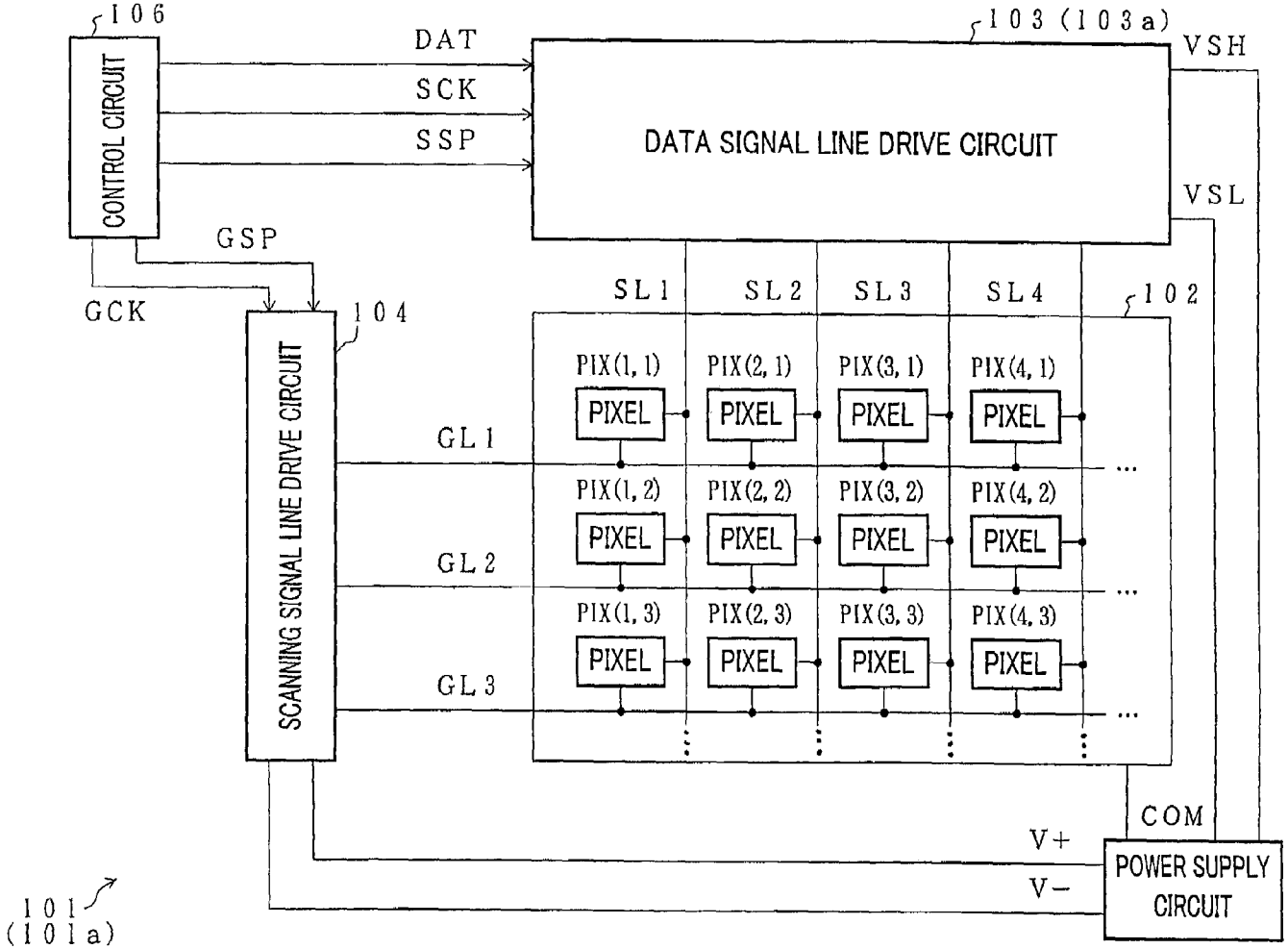
FIG. 16 PRIOR ART
FIG. 16 indicates a conventional example, and is a block diagram illustrating a substantial part of an image display device.
Figure 17:
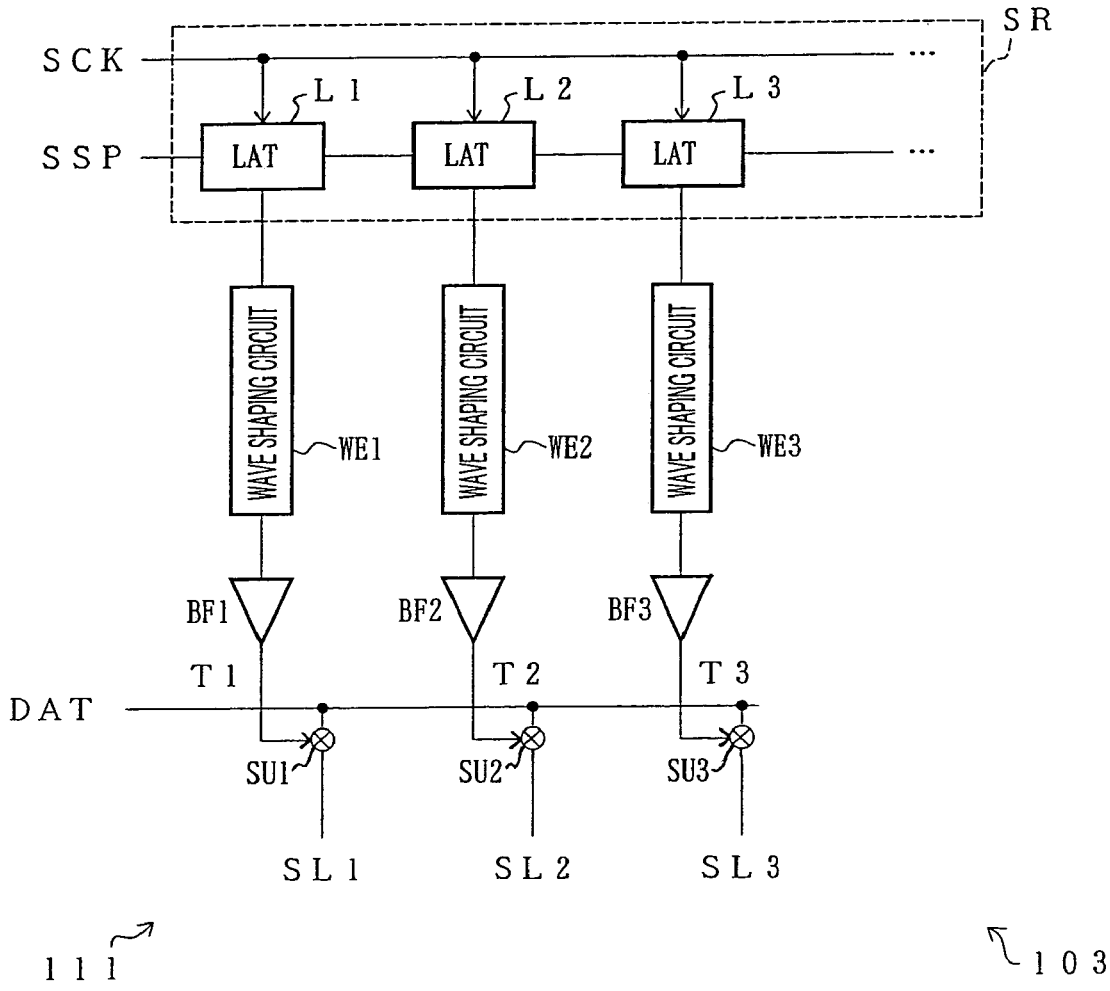
FIG. 17 PRIOR ART
FIG. 17 is a block diagram, illustrating a substantial part of a data signal line drive circuit provided in the image display device.
Figure 18:
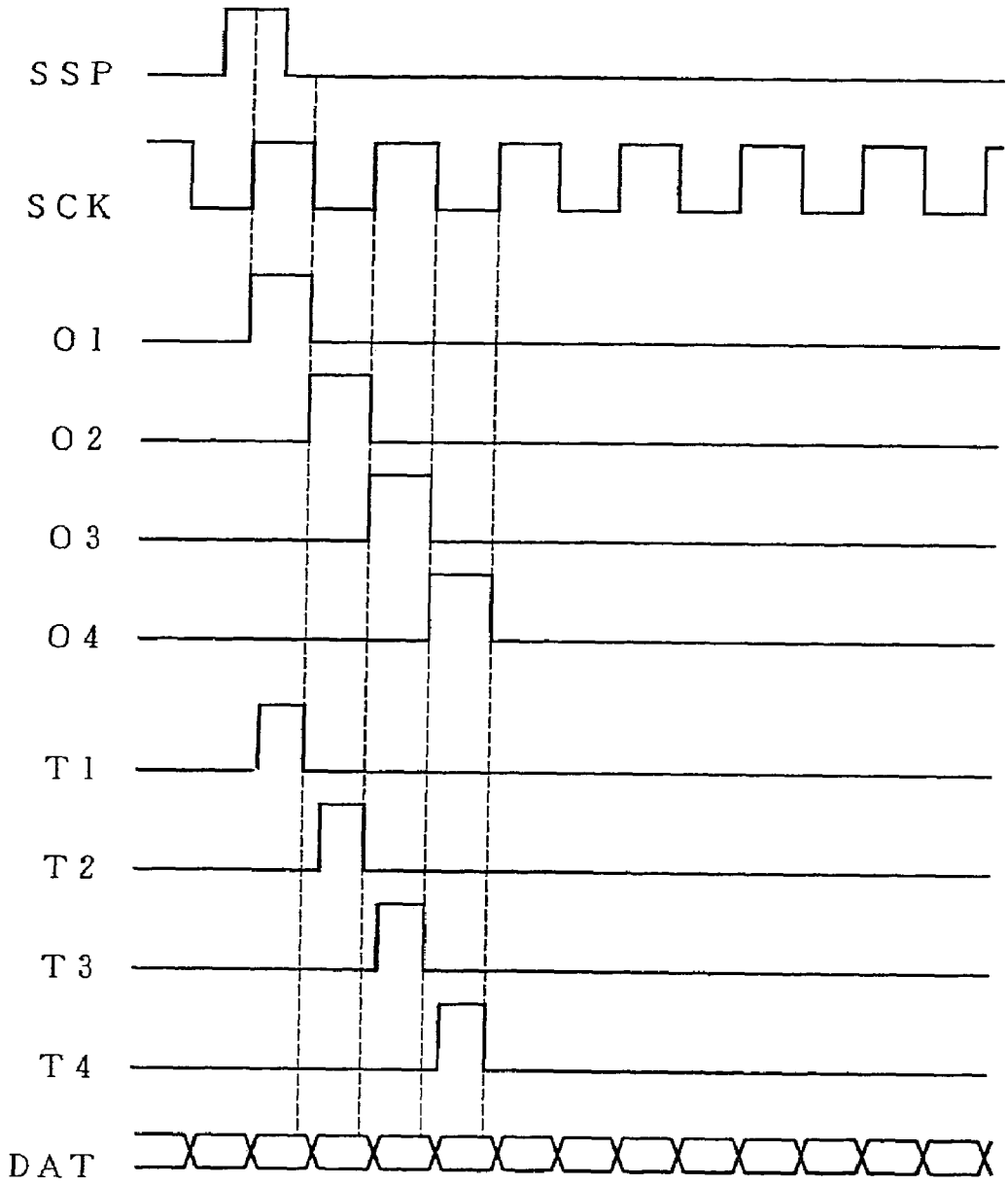
FIG. 18 PRIOR ART
FIG. 18, showing the operation of the data signal line drive circuit, is a waveform chart illustrating signal waveforms of different sections, on the occasion of low-resolution.

Although the description above takes the case of the operation of the shift register SRA on the occasion of low-resolution as an example, as a matter of course, the shift register SRB may be operated on the occasion of low-resolution such as a data signal line drive circuit 3*c* illustrated in FIG. 14, or the shift register SRC may be operated on the occasion of low-resolution such as a data signal line drive circuit 3*d* illustrated in FIG. 15. By the way, in the case of FIG. 14, the shift register SRB corresponds to a second shift register in claims, and the shift registers SRA and SRC correspond to a first shift register in claims. In the case of FIG. 15, the shift register SRC corresponds to a second shift register in claims, and the shift registers SRA and SRB correspond to a first shift register in claims.

Moreover, although First and Second Embodiments discuss the respective cases when the ratio of the signal line resolution on the occasion of high-resolution to the signal line resolution on the occasion of low-resolution is 2:1 and when the ratio is 3:1, provided that an arbitrary integral number not less than 2 is set as x such as, for instance, four shift registers of respective systems are provided on the occasion of the ratio of 4:1, x shift registers of respective systems may be provided when the ratio of the signal line resolutions is x:1.

Further, as an example of different resolutions, the foregoing description discusses a case which is arranged in such a manner that, either one of the image signal DAT of high-resolution or the image signal DAT of low-resolution is supplied to the data signal line drive circuit (3–3*d*). However, the number of resolutions capable of being inputted to the data signal line drive circuit is not limited to 2, and hence the number may be not less than 3.

Figure 21:
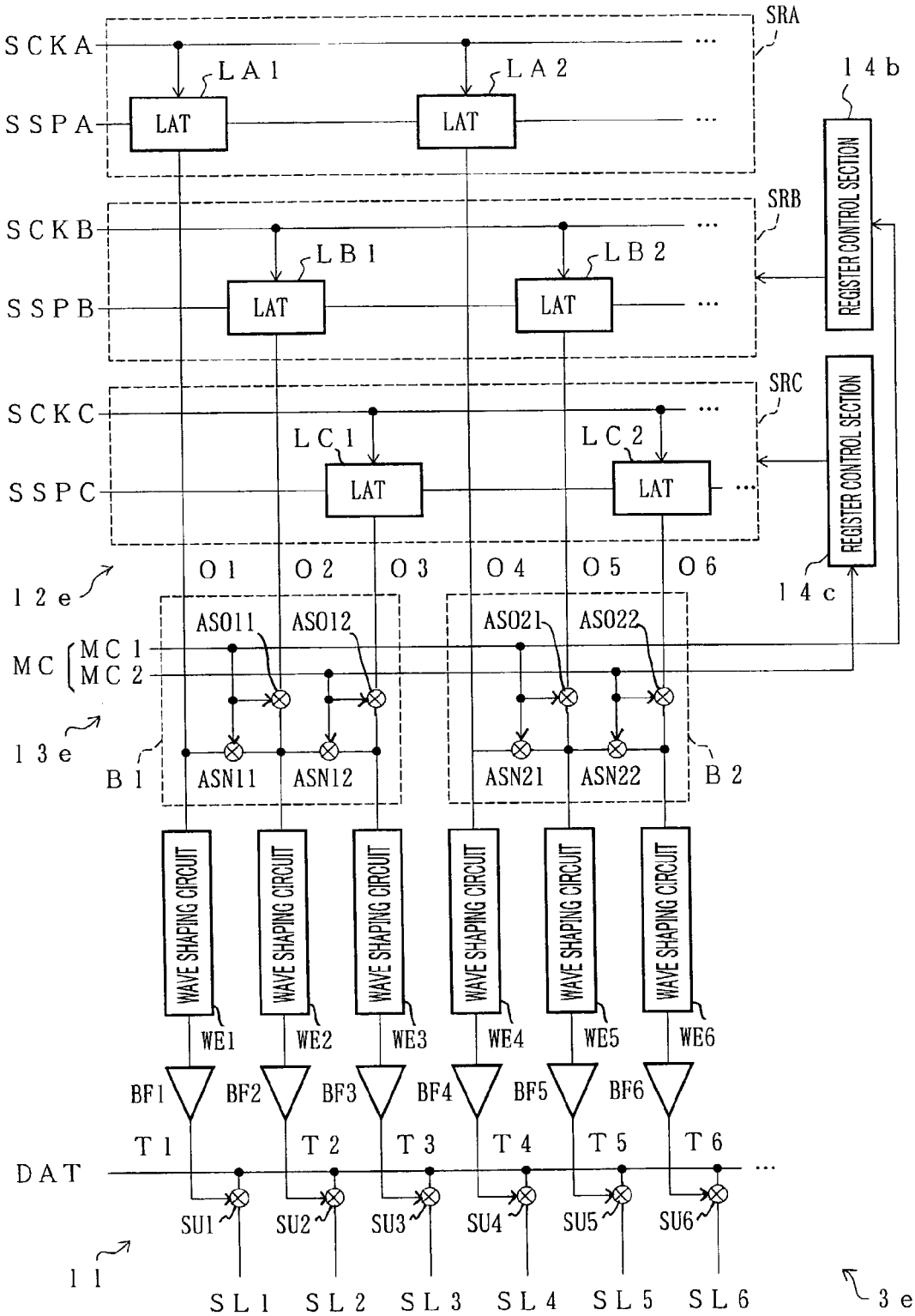
FIG. 21 is a block diagram, illustrating an alternative example of the data signal line drive circuit including shift registers belonging to different systems.

For instance, provided that any one of respective image signals DAT of high-resolution, of medium-resolution, and of low-resolution is supplied, in a data signal line drive circuit 3*e* which is illustrated in FIG. 21 and has an arrangement substantially identical with the data signal line drive circuit 3*b* in FIG. 11, all shift registers SRA–SRC are operated on the occasion of high-resolution (mode 1), only the shift register SRA is operated on the occasion of low-resolution (mode 3), and the shift registers SRA and SRB are operated on the occasion of medium-resolution (mode 2).

That is to say, to the data signal line drive circuit 3*e* in accordance with the present alternative example, a resolution switching signal MC indicating any one of high-resolution, medium-resolution, and low-resolution is supplied, instead of the resolution switching signal MC indicating either high-resolution or low-resolution. Also, register control sections 14*b* and 14*c* for controlling the operation/non-operation of respective shift registers SRB and SRC are provided in place of the register control section 14, so that the register control section 14*b* stops the shift register SRB when low-resolution is indicated by the resolution switching signal MC and causes the shift register SRB to be operated when medium or high-resolution is indicated by the resolution switching signal MC, whereas the register control section 14*c* causes the shift register SRC to be operated on the occasion of high-resolution and stops the shift register SRC on the occasion of medium or low-resolution.

Moreover, in the present alternative example, a switching section 13*e* provided in place of the switching section 13*b* generates timing signals T1–Tn in accordance with output signals O1–On supplied from the shift registers SRA–SRC, when the resolution switching signal MC indicates high-resolution, or generates timing signals T1–Tn in accordance with output signals O1, O4, from the shift register SRA when the resolution switching signal MC indicates low-resolution. When medium-resolution is indicated, the switching section 13*e* generates timing signals T1–Tn in accordance with output signals O1, O2, O4, supplied from the shift registers SRA and SRB.

In an example illustrated in FIG. 21, the resolution switching signal MC is supplied as a combination of resolution switching signals MC1 and MC2, so that the signal MC indicates high-resolution when the signals MC1 and MC2 are both at high-level, while the signal MC indicates low-resolution when the signals MC1 and MC2 are both at low-level. When the resolution switching signal MC1 is at high-level while the signal MC2 is at low-level, the resolution switching signal MC indicates medium-resolution. Also, the register control section 14*b* causes the shift register SRB to be operated when the resolution switching signal MC1 is at high level, and stops the shift register SRB when the signal MC1 is at low level. Similarly, the register control section 14*c* causes the shift register SRC to be operated/stopped in accordance with the level of the resolution switching signal MC2. Switches ASNk1 and ASOk1, which are provided in the same manner as in the arrangement in FIG. 11, are turned on/off in accordance with the level of the resolution switching signal MC1, whereas switches ASNk2 and ASOk2 are turned on/off in accordance with the resolution switching signal MC2.

Incidentally, shift registers operated on the occasions of respective resolutions (modes) are not limited to the example in FIG. 21, so that, for instance, a possible arrangement is such that the shift registers SRA and SRB are operated at mode-2 resolution while either one of the shift registers SRB and SRC is operated at mode-3 resolution. Other possible arrangements are such that the shift registers SRB and SRC are operated at mode-2 resolution while one of the shift registers SRA, SRB, and SRC is operated at mode-3 resolution, and the shift registers SRB and SRC are operated at mode-2 resolution while one of the shift registers SRA, SRB, and SRC is operated at mode-3 resolution. At all events, it is possible to acquire the aforementioned effects when: all of the shift registers SRA, SRB, and SRC are operated at mode-1 resolution; any two of the shift registers SRA, SRB, and SRC are operated at mode-2 resolution; and any one of the shift registers SRA, SRB, and SRC is operated at mode-1 resolution.

When four shift registers SRA, SRB, SRC, and SRD (not illustrated) of respective systems are provided, it is possible to acquire the aforementioned effects when: all of the shift registers SRA, SRB, SRC, and SRD are operated at mode-1 resolution; any three of the shift registers SRA, SRB, SRC, and SRD are operated at mode-2 resolution; any two of the shift registers SRA, SRB, SRC, and SRD are operated at mode-3 resolution; and any one of the shift registers SRA, SRB, SRC, and SRD is operated at mode-1 resolution.

However, since the ratio of the signal line resolutions is often represented by integral multiples such as 4:2:1, when, for instance, four shift registers SRA, SRB, SRC, and SRD of respective systems are provided, the resolution mode can be arranged so as to be switched to mode 1, mode 3, or mode 4, and mode 2 is ignored.

As described above, in the signal line drive circuit provided with the scanning section (scanning circuit sections 12–12*d*) for outputting timing signals, which indicate timings of the operation of respective signal line drive sections in accordance with input signals, to the signal line drive sections provided corresponding to respective signal lines, it is possible to acquire constant effects as long as a plurality of shift registers (SRA–SRC) and control means (register control sections 14–14*c*) for causing at least a part of the shift registers to be stopped or operated in accordance with the signal line resolutions of the input signal are provided in the scanning section.

[Third Embodiment]

The description above has discussed about the arrangement in which a plurality of shift registers (SRA–SRC) of respective systems are provided in a scanning section (scanning circuit sections 12–12*d*) and the operation/non-operation of the systems is controlled in accordance with the signal line resolutions. However, even if a single shift register of one system is provided, it is possible to acquire some effects on condition that the operation of the shift register is partly stopped in accordance with the signal resolutions.

Figure 19:
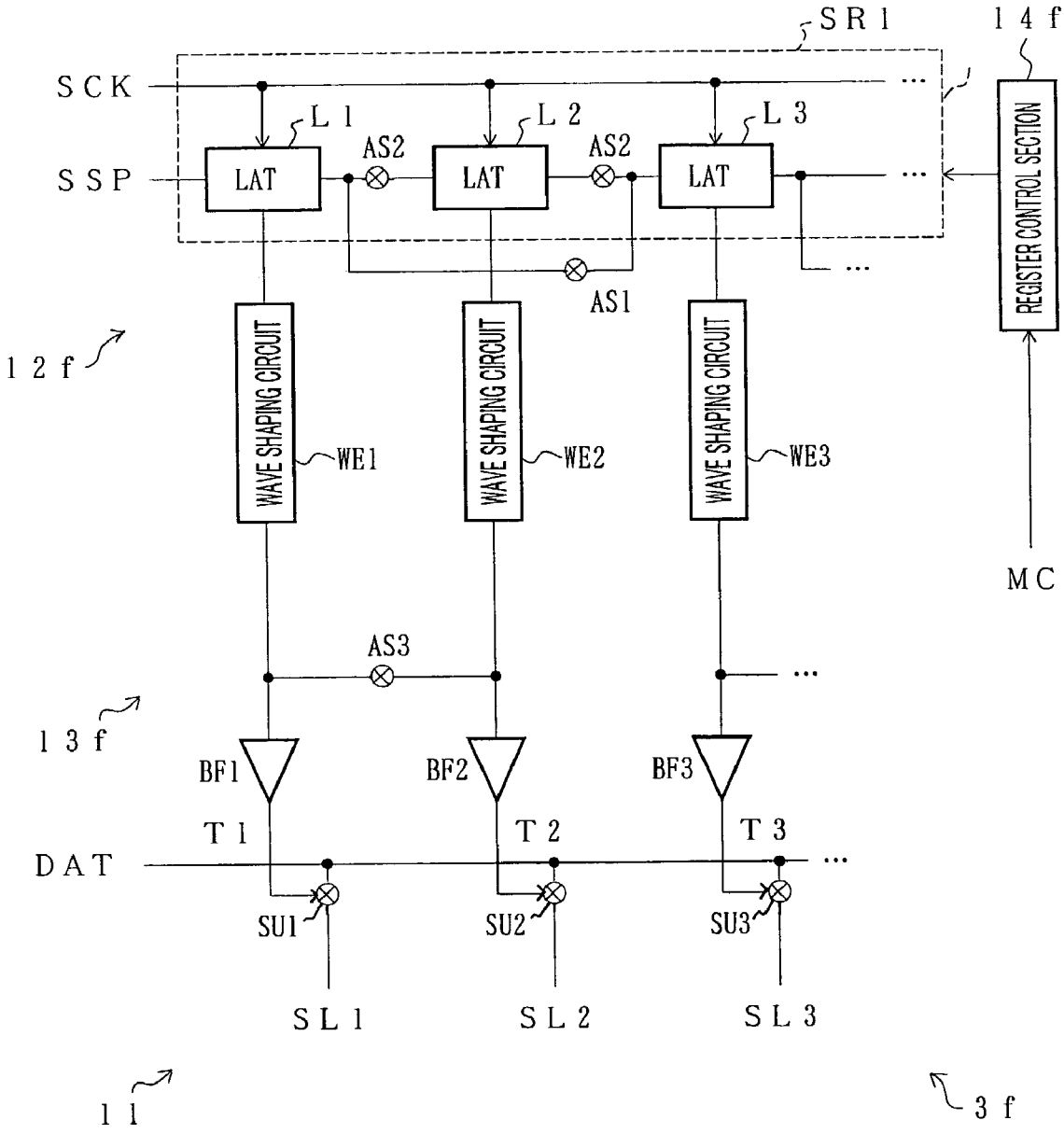
FIG. 19 is a block diagram related to a further embodiment in accordance with the present invention, illustrating an arrangement of a substantial-part of a data signal line drive circuit.
Figure 20:
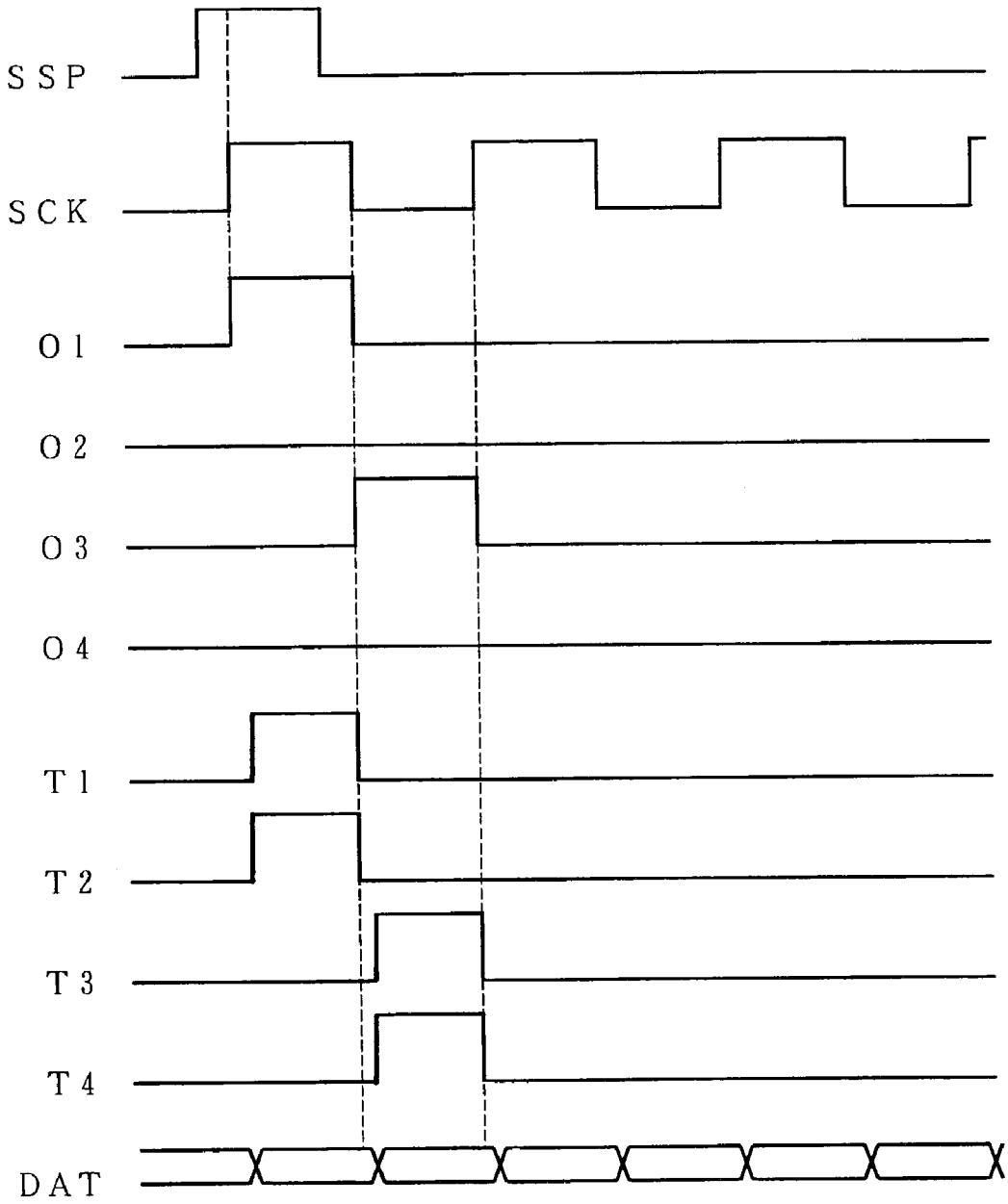
FIG. 20, showing the operation of the data signal line drive circuit, is a waveform chart illustrating signal waveforms of different sections, in low-resolution mode.

For instance, provided that a scanning section is provided in a data signal line drive circuit, a data signal line drive circuit 3*f* of an image display device 1 in FIG. 2 is provided with a single shift register SR1 of one system, as illustrated in FIG. 19. the shift register SR1 includes switches AS1 for connecting the output from an odd-number-th stage (e.g. L1) with the input to the next odd=numbered stage (e.g. L3), on the occasion of low-resolution mode in which case an image signal DAT of low-resolution is inputted. Moreover, before and after an even-number-th stage (e.g. L2), switches AS2 for cutting off the even-number-th stage from the previous stage (e.g. L1) and the next stage (e.g. L3) are provided. Here, the switches AS1 and AS2 correspond to switches in claims.

Further, the outputs from odd-number-th wave shaping circuits WE1, WE3 are supplied to a switching section 13*f* including switches AS3 for connecting the wave shaping circuits above with the next wave shaping circuits WE2 on the occasion of low-resolution mode. In this arrangement, the conduction/shutoff of the switches AS1–AS3 is controlled in accordance with a resolution switching signal MC.

In the data signal line drive circuit 3*f* with the above-mentioned arrangement, a signal is shifted via all stages of the shift register SR1, on the occasion of high-resolution mode. In this case, when a start pulse signal SSP is supplied to the first stage L1 of the shift register SR1 of the data signal line drive circuit 3*f*, the shift register SR1 causes the outputs from the respective stages (L1 . . . ) to be shifted to the next stages (L2 . . . ), at a shift cycle specified by a clock signal SCK. On this account, the output signal waveforms of respective latch circuits L1–Ln constituting respective stages of the shift register SR1 have waveforms O1–On which are shifted with each other by one shift cycle.

The output signals O1–On are subjected to adjustment of the pulse widths in respective wave shaping circuits WE1–WEn, and then subjected to buffering in respective buffer circuits BF1–BFn, so as to be outputted as timing signals T1–Tn. Further, a sampling section 11 writes image signals DAT which are sampled in each different timing to the data signal lines SL1–SLn, in accordance with the timing signals T1–Tn. As a result, the image display device 3*f* displays the image signals DAT with horizontal resolution corresponding to the number of the data signal lines SL1–SLn.

In contrast, on the occasion of low-resolution mode when an image signal DAT whose horizontal resolution is half as much as that of the image signal DAT of the high-resolution mode is imputed, the control circuit 6 outputs a clock signal SCK which specifies the shift cycle in consistency with the sampling cycle of the image signal DAT of low-resolution. Also, in the data signal line drive circuit 3*f*, the switch AS2 is shut off while the switch AS1 is brought into conduction. On this account, in the shift register SR1, every other latch circuits L1–Ln of the shift register SR1 are used, so that a signal is shifted bypassing either the even-number-th stages or the odd-number-th stages (in this example, the even-number-th stages).

For this reason, the output waveforms O1, O3, from the odd-number-th stages of the shift register SR1 are, as FIG.

20 illustrates, shifted at the above-mentioned sampling timing. Moreover, on the occasion of low-resolution mode, odd-number-th wave shaping circuits WE1, WE3, are connected to respective odd-number-th sampling units SU1, SU3, and the next sampling units SU2, SU4, since the switch AS3 is turned on. Thus, to neighboring sampling units (e.g. SU1 and SU2), timing signals having an identical timing (e.g. T1 and T2) are supplied, and these sampling units sample the image signals DAT at an identical timing. As a result, the data signal line drive circuit 3*f* can drive the neighboring data signal lines (e.g. SL1 and SL2) as a single set, and write the data having a single value into these data signal lines.

Consequently, apparent signal line resolution (horizontal resolution) of the image display device 1 is half as much as the actual signal line resolution, so as to be in consistency with the signal line resolution of the image signal DAT. As in the forgoing description, also in the present embodiment, it is possible to match the apparent signal resolution with the signal resolution of the image signal DAT by writing the data having a single value into pixels PIX which are adjacent to each other, when an image signal DAT whose signal line resolution is lower than the actual signal line resolution of the image display device 1. Thus, even if the image signal DAT whose signal line resolution is lower than the actual signal line resolution is inputted, high-definition images can be displayed.

In the present embodiment, when the image signal DAT of low-resolution is supplied, a part of the shift register SR1 (in this example, even-number-th stages) is caused to be in the state of non-operation so that the shift register is sorely composed of odd-number-th stages which have been operated, and hence, as illustrated in FIG. 2, the control circuit 6*f* lowers the frequency of the clock signal SCK to be half as much as the frequency of the clock signal SCK on the occasion of high-resolution. Also, the control circuit 6*f* causes the frequency of the image signal DAT of low-resolution to be lower than the frequency of the image signal DAT of high-resolution. On this account, it is possible to reduce the power consumption of an external circuit (e.g. control circuit 6*f*) generating the clock signal SCK and the image signal DAT. Here, the description above relates to the reduction of the frequency of the clock signal SCK to ½ when only the horizontal resolution varies. However, when the reduction is carried out not only in the horizontal resolution (to ½, for instance) but also in the vertical resolution (to ½, for instance) of the image signal DAT, the frequency of the clock signal SCK is reduced by a product of the decreasing rate of the vertical resolution multiplied by the decreasing rate of the horizontal resolution (reduced to ¼, for instance).

Furthermore, in accordance with the resolution switching signal MC, the register control section 14*f* of the present embodiment stops latch circuits which are not used on the occasion of the signal line resolution of the image signal DAT which has been supplied, by, for instance, interrupting the power supply to the bypassed latch circuits (in this case, the even-number-th circuits), and this enables to reduce the power consumption of the shift register SR1 on the occasion of non-operation.

Incidentally, in the present embodiment, even-number-th stages of the shift register SR1 are stopped on the occasion of the input of the image signal DAT of low-resolution, and only the odd-number-th stages are operated. However, the present invention is not limited to this arrangement, and hence there is a possible arrangement such that odd-number-th stages of the shift register SR1 are stopped and only the even-number-th stages are operated, on the occasion of the input of the image signal DAT of low-resolution.

In the present embodiment, the shift register SR1 is divided into the block of odd-number-th stages and the block of even-number-th stages, and the operation/non-operation of the stages is controlled in accordance with the signal line resolution of the image signal DAT. However, the present embodiment is not limited to this arrangement so that the shift register SR1 may be divided into not less than three blocks. For instance, the shift register SR1 is divided into a block composed of (3i−2) stages, a block of (3i−1) stages, and a block of (3i) stages (i is a natural number), and: all of the blocks are operated when the image signal DAT of high-resolution is inputted: or (3i−2) stages are operated while (3i−1) and (3i) stages are stopped when the image signal DAT of low-resolution is inputted. Further, the resolution is not necessarily switched between two resolutions, so that the resolution may be switched between not less than three resolutions. In this case, some latch circuits are selected from the latch circuits constituting the shift register SR1, the number of the selected latch circuits corresponds to the resolution, and the selected latch circuits constitute a shift register by, for instance, switching the connections between the latch circuits.

At any events, it is possible to acquire the aforementioned effects when whether or not a signal is shifted by bypassing some parts of the stages of the shift register SR1 is determined in accordance with the resolution of the image signal DAT.

However, as in First and Second Embodiments, when a plurality of shift registers (SRA–SRC) of respective systems are provided in a scanning section (scanning circuit sections 12–12*d*) and the operation/non-operation of the systems is controlled in accordance with signal line resolution, even in the case of high-resolution, the drive frequency of shift registers operated on the occasion of low-resolution is restrained so as to be lower than the drive frequency in the arrangement of Third Embodiment (e.g. ½ in the case of two systems). Moreover, since the maximum drive frequency of latch circuits constituting respective stages of the shift registers is reduced, it is possible to realize the latch circuits using slower circuits. As a result, it is possible to further restrain the power consumption of the data signal line drive circuit (3–3*e*).

[Fourth Embodiment]

Figure 23:
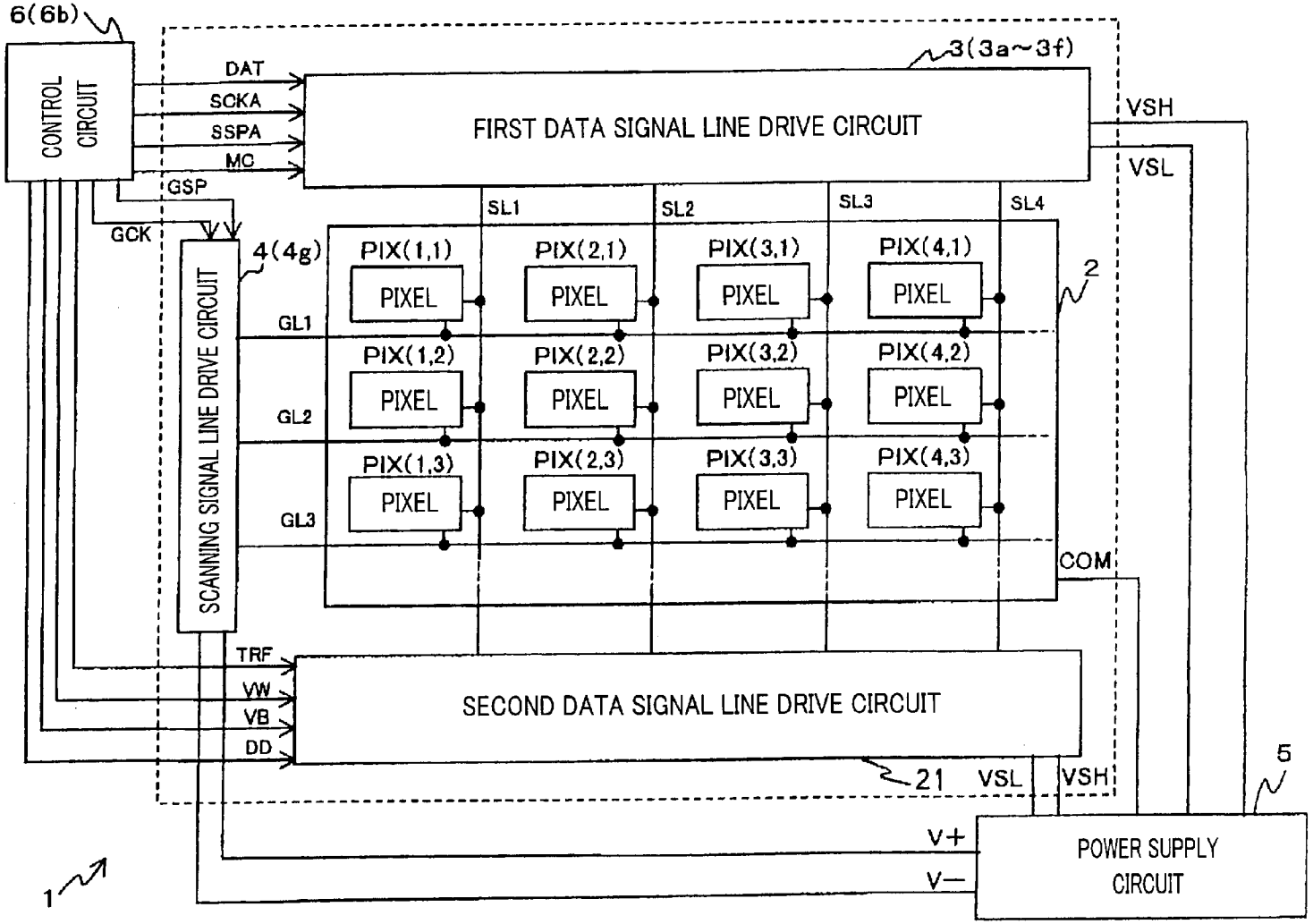
FIG. 23 is a block diagram related to yet another embodiment in accordance with the present invention, illustrating an arrangement of a substantial part of an image display device.

Referring to FIG. 23, the present embodiment describes an image display device 1*h* which is provided with, in addition to the data signal line drive circuit (3, 3*a*–3*f*) driving data signal lines SL1–SLn, a second data signal line drive circuit 21 capable of driving at least one of the data signal lines SL1–SLn.

That is to say, the image display device 1*h* is provided with a second data signal line drive circuit 21. This second data signal line drive circuit 21 drives data signal lines SL1–SLn of a pixel array 2, and the data signal lines SL1–SLn are commonly connected to a data signal drive circuit 3 (3*a*–3*f*) as a first data signal line drive circuit, and the second data signal line drive circuit 21. Here, it is noted that the second data signal line drive circuit 21 corresponds to a second signal line drive circuit in claims. Further, although FIG. 23 illustrates that all of the data signal lines SL1–SLn are connected to the second data signal line drive circuit 21, if displaying is not carried out on the entire display area, at least one of the data signal lines SL1–SLn may be connected to the second data signal line drive circuit 21. Further, as in the foregoing drive circuit 3 (3*a*–3*f*), although the second data signal line drive circuit 21 and the pixel array 2 may be separately formed, it is preferable to form the second data signal line drive circuit 21 and the pixel array 2 on the same substrate, i.e., formed in a monolithic manner, when the reduction of manufacturing costs or mounting costs of the drive circuits is required.

To the second data signal line drive circuit 21, a transfer indication signal TRF, a lighting potential VW, a non-lighting potential VB, a display binary data signal (digital data) DD are supplied from a control circuit 6 (6*b*). Further, although not being illustrated, clock signals synchronized with clock signals SCKA and SSPA to the first data signal line drive circuit 3 (3*a*–3*f*) are supplied as timing signals, from the control circuit 6 (6*b*). With this arrangement, it is possible to carry out displaying in sync with the supplied signals.

Figure 24:
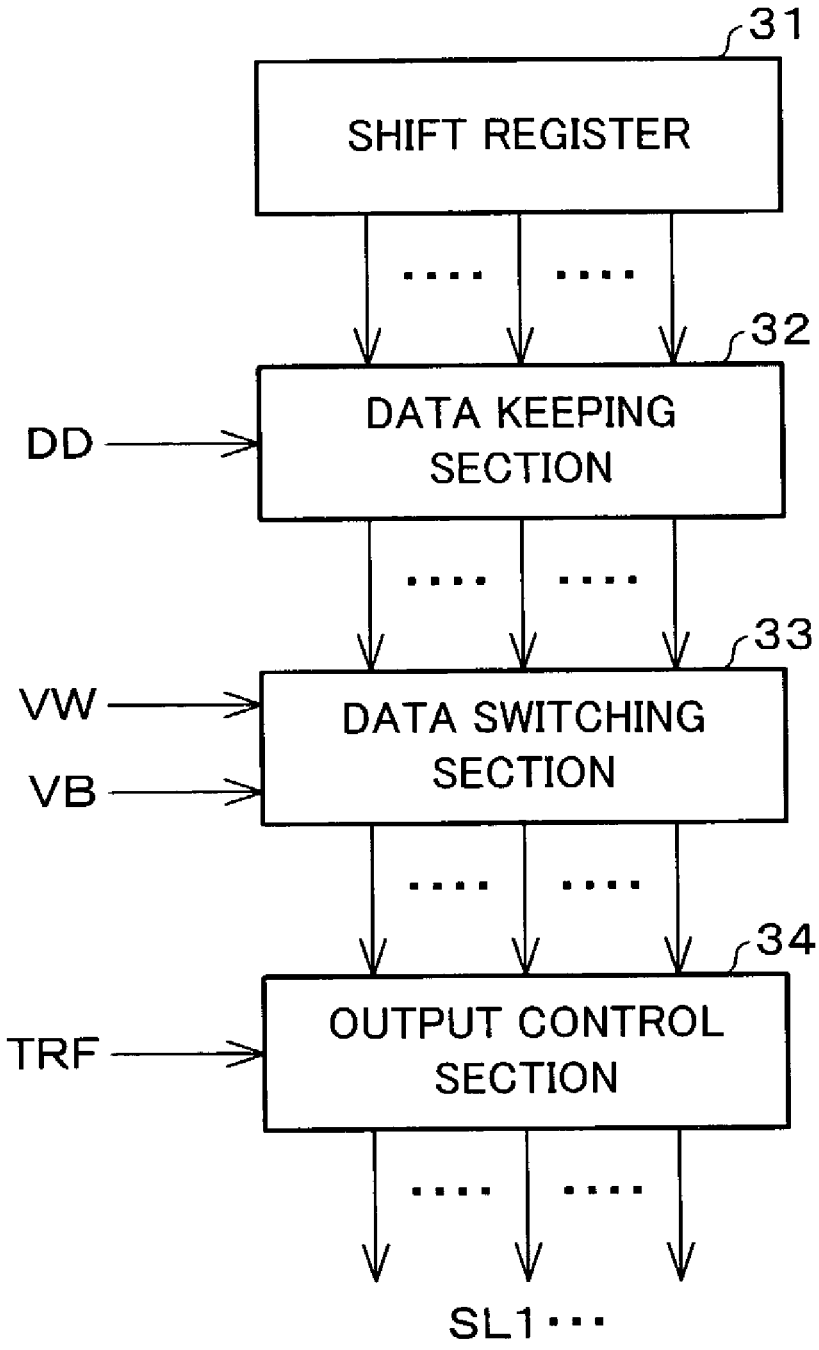
FIG. 24 is a block diagram, illustrating a substantial part of a second data signal line drive circuit provided in the foregoing image display device.

As illustrated in FIG. 24, the second data signal line drive circuit 21 includes: a shift register 31 for supplying sampling signals in accordance with the supplied timing signals; a data keeping section 32 which samples the binary data signal DD additionally supplied in accordance with the output from the shift register 31, so as to keep the same; a data switching section 33 for switching between the binary data potentials of the lighting potential VW and the non-lighting potential VB, in accordance with the binary data signal having been kept in the data keeping section 32; and an output control section 34 for controlling the output from the data switching section 33 by the transfer indication signal TRF, the output control section 34 being provided between the output signal of the data switching section 33 and the data signal lines SL1–SLn.

In this arrangement, when the pixel array 2 is normally-black type, the data switching section 33 selects the lighting potential VW, and on the occasion of the input of the transfer indication signal TRF, the output control section 34 controls the output in order to carry out lighting-display. When the non-lighting potential VB has been selected by the data switching section 33, the output control section 34 does not operate even if the transfer indication signal TRF is supplied.

Meanwhile, when the pixel array 2 is normally-white type, the data switching section 33 selects the non-lighting potential VB, and on the occasion of the input of the transfer indication signal TRF, the output control section 34 controls the output in order to carry out non-lighting-display. When the lighting potential VW has been selected by the data switching section 33, the output control section 34 does not operate even if the transfer indication signal TRF is supplied.

As described above, owing to the drive of the data signal lines SL1–SLn by the second data signal line drive circuit 21 and the drive of the scanning lines GL1–GLm by the scanning line signal drive circuit 4, it is possible to carry out displaying of binary data.

Here, it is noted that when, for instance, the displaying of binary data is carried out in addition to the displaying of image data (video image data) for high-resolution image display such as multi-gradation, color, and high frame frequency, using only a signal line drive circuit for high-resolution image display, unnecessary increase of power consumption could be caused.

To solve this problem, the image display device 1*h* in accordance with the present embodiment is provided with a second data signal line drive circuit (21) for binary data display in addition to a first data signal line drive circuit 3 (3*a*–3*f*) for high-resolution image display such as high frame frequency. With this arrangement, it is possible to reduce the power consumption for the binary data display.

Incidentally, There is such an arrangement that a binary data image such as characters displayed by the second data signal line drive circuit 21 is superimposed on a high-resolution display image displayed by the first data signal line drive circuit 3 (3*a*–3*f*), and this arrangement makes it possible to display superimposed images without using an image composite section for superimposing a binary data image on a high-resolution image in advance. Further, there is such a possible arrangement that a binary data image by the second data signal line drive circuit 21 and a high-resolution image by the first data signal line drive circuit 3 (3*a*–3*f*) are displayed on different areas of the display area, respectively.

To display high-resolution images such as multi-gradation, color, and high frame frequency, a video interface IC is typically provided. For instance, the video interface IC receives a control signal from the control circuit 6 (6*b*) so that the video interface IC outputs an image signal DAT to the first data signal line drive circuit 3 (3*a*–3*f*) so that the drive circuit 3 (3*a*–3*f*) is driven for displaying as above. Since the second data signal line drive circuit 21 is provided, it is unnecessary to drive the interface IC for multi-gradation image signals, and hence the power consumption can be reduced.

Although FIG. 23 illustrates such an arrangement that the second signal line drive circuit 21 is provided so as to be opposite to the first signal line drive circuit 3 (3*a*–3*f*) with respect to the pixel array 2 of the display area, i.e. the first signal line drive circuit 3 (3*a*–3*f*) and the second signal line drive circuit 21 are provided so as to sandwich the pixel array 2 of the display area, it is possible to arrange these members in such a manner that the first signal line drive circuit 3 (3*a*–3*f*) and the second signal line drive circuit 21 are provided on the same side of the pixel array 2 of the display area. When the second signal line drive circuit 21 is provided so as to be opposite to the first signal line drive circuit 3 (3*a*–3*f*) with respect to the pixel array 2 of the display area, it is possible to efficiently provide the members on the substrate and avoid the complexity of the wire arrangement and the interference between the wires. When the first signal line drive circuit 3 (3*a*–3*f*) and the second signal line drive circuit 21 are provided on the same side of the pixel array 2 of the display area, these members can share some wires so that signal delay and the skew of waveform can be avoided.

It is noted that although the second data signal line drive circuit 21 in the foregoing descriptions is sorely for binary data display, the present invention is not limited to this arrangement. For instance, there is such a possible arrangement that the second data signal line drive circuit 21 and the first data signal line drive circuit 3 (3*a*–3*f*) have an identical constitution but different resolutions, and both of these circuits carry out the display of images with similar qualities.

Further, for instance, the second data signal line drive circuit 21 may be provided for displaying binary data with a plurality of different resolutions. In this case, as in the first data signal line drive circuit 3 (3*a*–3*f*), the second data signal line drive circuit 21 is arranged in such a manner that a scanning section, which outputs timing signals specifying the timings with which signal line drive sections corresponding to respective signal lines are operated in accordance with the input signal, is provided, and the scanning section is provided with: first and second shift registers of respective systems; and control means which causes the first and second shift registers to be operated in case of high-resolution mode, and causes the first shift register to be stopped in case of low-resolution mode in which mode an input signal whose signal line resolution is lower than that of an input signal in the case of high-resolution mode is supplied.

In the foregoing embodiments, on the occasion of high-resolution mode, one data signal line SLi (one sampling unit) is allocated with respect to each output Oi from the scanning circuit section 12. However, the allocation of data signal lines is not limited to this arrangement. For instance, when a plurality of sampling units are driven at an identical timing regardless of the mode of resolution, e.g. (i) when each pixel is composed of R, G, and B sub pixels, and sampling units for driving data signal lines connected to the respective sub pixels are driven at an identical timing regardless of the mode of resolution and (ii) when an image signal DAT is divided so as to be transmitted through a plurality of signal lines, and sampling units for sampling the respective parts of the divided image signal DAT are driven at an identical timing regardless of the mode of resolution, it is possible to allocate a group of these sampling units to each output Oi on the occasion of high-resolution mode. In this arrangement, in accordance with each output from each stage of at least one shift register which has been operated, among the groups of the sampling units, a plurality of groups which are driven at sequential timings are driven on the occasion of low-resolution mode.

Further, although the data signal lines SL1–SLn are point-sequentially driven in the foregoing embodiments, the lines SL1–SLn may be line-sequentially driven. Also in this arrangement, there is a sampling section for sampling image data D, which indicates signals to be outputted to the respective data signal lines SL1–SLn, from image signals DAT. Thus, it is possible to acquire the aforementioned effects by generating timing signals T1–Tn supplied to the sampling section, using a scanning circuit section and a switching section both having arrangements identical with those in the data signal line drive circuit 3 (3*a*–3*f*).

Moreover, although the shift registers (SRA–SRC, SR1) are shifted at the both edges of the clock signals (SCKA–SCKC, SCK) in the foregoing embodiments, the present invention is not limited to this arrangement so that it is possible to acquire similar effects by causing the shift registers to be shifted in sync with the clock signals. However, it is noted that the frequency of the clock signals in the arrangement of shifting at both edges is reduced so as to be half as much as the frequency of the clock signals in the arrangement of shifting at one edge, provided that the shift cycle is identical in these two arrangements, and hence the former arrangement makes it possible to reduce the power consumption of a circuit for generating the clock signals.

In First and Second Embodiments, the wave shaping circuits WE1–WEn and the buffer circuits BF1–BFn are provided between the scanning circuit section 12 (12*a*–12*e*) and the switching section 13 (13*a*–13*e*). However, the present invention is not limited to this arrangement. Thus, for instance, there is a possible arrangement such that wave shaping circuits (WE1–WEn) are provided between a scanning circuit section (12*f*) and a switching section (13*f*) while buffer circuits (BF1–BFn) are provided between the switching section (13*f*) and a sampling section (11). In this arrangement, it is possible to acquire the effects substantially identical with the effects acquired by the foregoing embodiments, even if the scanning circuit section 12 (12*a*–12*f*), the switching section 13 (13*a*–13*f*), the sampling section 11, the wave shaping circuit (WE1–WEn), and the buffer circuits (BF1–BFn) are arranged in a different order.

Moreover, even if the sampling section 11 is directly driven by the scanning circuit section 12 (12*a*–12*f*), it is possible to omit the wave shaping circuits WE1–WEn and the buffer circuits BF1–BFn, on condition that the scanning circuit section 12 (12*a*–12*f*) has the ability of driving, which is sufficient to confine the fluctuation of sampling timings to a permissible limit.

However, the higher the signal line resolution is, the narrower the permissible limit is, and polycrystalline silicon thin-film transistors often have a limited ability of driving, compared to transistors made of single crystal silicon. Thus, when the data signal line drive circuit 3 (3*a*–3*f*) which is an active element is formed by a polycrystalline silicon thin-film transistor or when the maximum signal line resolution is high, it is preferable to provide the wave shaping circuits WE1–WEn and the buffer circuits BF1–BFn as in the foregoing embodiments.

Further, even if, in First and Second Embodiments, the switches (ASN) for interrupting the signal paths from the shift registers in the state of non-operation are provided in the switching section 13 (13*a*–13*d*), the present invention is not limited to this arrangement. Thus, it is possible to do away with the switches on condition that the circuit arrangement of the shift registers and the power supply to the shift registers are arranged so as to cause the outputs from the shift registers in the state of non-operation not to obstruct the transmission of signals from the shift registers in the state of operation to the respective sampling units. Similarly, although Third Embodiment is arranged in such a manner that the switches AS2 for cutting off the latch circuits in the state of non-operation from the latch circuits in the state of operation are provided, the present invention is not limited to this arrangement. Thus, it is possible to do away with the switches on condition that the circuit arrangement of the latch circuits and the power supply to the latch circuits are arranged so as to cause the outputs from the latch circuits in the state of non-operation not to obstruct the transmission of signals to the latch circuits in the state of operation.

However, when the switches are provided, it is possible to stop (i) the power supply to the shift registers or the latch circuits in the state of non-operation and (ii) the supply of various control signals (a shift pulse, a clock signal, etc.) to these members in the state of non-operation, no matter what kind of circuits are used to construct the shift registers and the latch circuits constituting the shift registers.

Regardless of the ratio x:1 of the signal line resolutions, the driving method of signals, the existence of the wave shaping circuits etc., and the arrangement of the switching section, the data signal line drive circuit in accordance with First and Second Embodiments generates the timing signals T1–Tn for sampling the image signal DAT of high-resolution, while restraining the drive frequency of each shift register by using all shift registers of respective systems, and also the data signal line drive circuit in accordance with First and Second Embodiments generates the timing signals T1–Tn for sampling the image signal DAT of low-resolution, using at least one of the shift registers which is: optimized for the low-drive frequency; small-sized; and low-power consumption type. Moreover, in the data signal line drive circuit in accordance with Third Embodiment, while the timing signals T1–Tn for sampling the image signal DAT of high-resolution are generated using all latch circuits of the shift register SR1 on the occasion of high-resolution, the timing signals T1–Tn for sampling the image signal DAT of low-resolution are generated in accordance with the output signals from the shift register which is composed of some of the latch circuits of the shift register SR1, on the occasion of low signal line resolution. As a result, it is possible to not only change apparent signal line resolution in accordance with the signal line resolution of the image signal DAT but also realize a data signal line drive circuit which is capable of driving the data signal lines SL1–SLn with low power consumption.

Incidentally, although the description above relates to the data signal line drive circuit 3 (3*a*–3*f*) of the active matrix image display device 1, the present invention is not limited to this arrangement. For instance, when an image forming device such as printers forms an electrostatic latent image by controlling the brightness of a plurality of areas provided in a linear manner, the present invention can be used for a data signal line drive circuit for driving data signal lines connected to the respective areas.

In any case, as long as the data signal line drive circuit (i) samples data from an input signal, which is for transmitting the data indicating signals to be supplied to data signal lines, in a time division manner and (ii) drives the data signal lines in accordance with the results of the sampling, the data signal line drive circuit can generate timing signals for properly sampling the data with low power consumption, even if any one of the input signals each having different signal line resolution is supplied, as in the foregoing embodiments.

Moreover, the foregoing descriptions relate to the arrangement such that the switching section 13 (13*a*–13*f*) is provided between the shift register(s) (SRA–SRC or SR1) and the sampling section 11 so that, on the occasion of low signal line resolution, the timing signals indicating an identical timing are supplied to a plurality of the sampling units in accordance with the output from a single stage of the shift register(s), and the data having an identical value are supplied to the respective data signal lines corresponding to the respective sampling units. However, the present invention is not limited to this arrangement.

For instance, the switching section 13 (13*a*–13*f*) may be provided between the sampling units SU1–SUn and the data signal lines SL1–SLn. With this arrangement, when the signal line resolution is low, in accordance with the outputs from the respective stages of the shift registers which are in the state of operation (e.g. latch circuits LAT1–LATp of the shift register SRA in accordance with First Embodiment), the sampling units SU corresponding to the aforementioned stages sample the image signal DAT. Moreover, in the switching section 13 (13*a*–13*f*), (i) a signal path from the sampling unit SU to a data signal line SL corresponding to the sampling unit SU and (ii) a signal path from the sampling unit SU to a data signal line SL adjacent to the data signal line SL in (i) are formed. In this case, when the signal line resolution is high, signal paths from the sampling units SU1–SUn to the corresponding data signal lines SL1–SLn are formed in the switching sections 13 (13*a*–13*f*).

Also in this case, when the signal line resolution is low, an input signal (image signal DAT), which has been sampled at a sampling timing specified by an output from a single stage of the shift register which is in the state of operation, is supplied to a plurality of data signal lines SL which are adjacent to each other, so that it is possible to acquire the aforementioned effects.

However, as in the above-mentioned embodiments, when the switching section 13 (13*a*–13*f*) is provided before the sampling section 11 rather than after the sampling section 1 1, the data signal outputted from the sampling section 11 can be written into a plurality of data signal lines, without passing through the switching section 13 (13*a*–13*f*). Thus, no errors due to the passing through the switching section 13 (13*a*–13*f*) occur in the data, and hence it is possible to write highly precise data into the data signal lines.

Moreover, although the case of driving the data signal lines is discussed in the descriptions above, the present invention is not limited to this. Thus, for instance, even in the scanning signal line drive circuit 4 which is illustrated in FIG. 2, the number of timings of driving the respective scanning signal lines GL1–GLm varies in accordance with the scanning signal line resolution of the image signal DAT.

Figure 22:
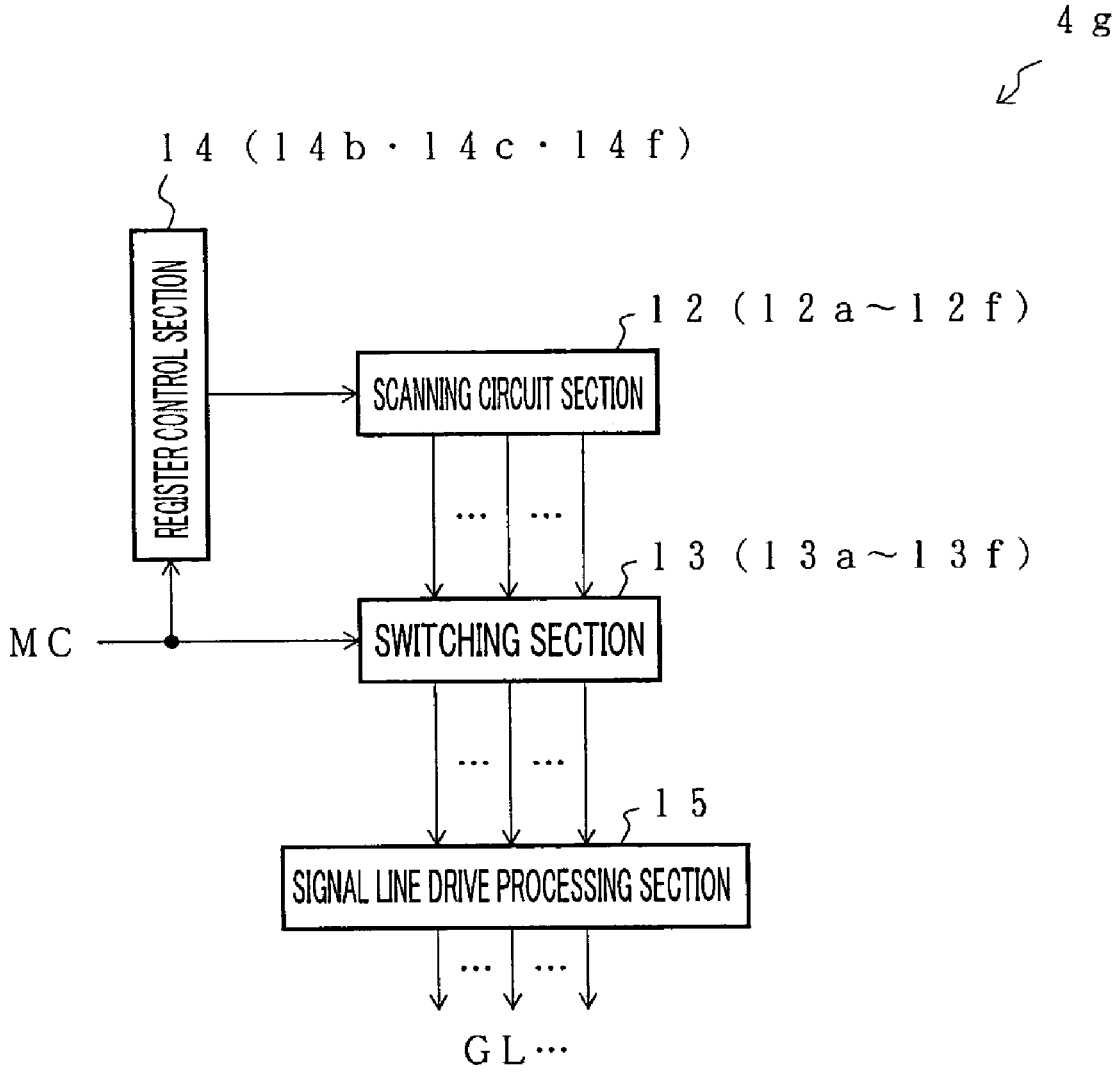
FIG. 22 illustrates an alternative example of the image display device, and is a block diagram illustrating a substantial part of a scanning signal line drive circuit.

For this reason, for instance, as in a scanning signal line drive circuit 4*g* illustrated in FIG. 22, it is possible to reduce the power consumption by adopting arrangements such that, (i) as in the data signal line drive circuit (3, 3*a*–3*e*) of First and Second Embodiments, a plurality of shift registers and a scanning circuit section (12–12*e*) controlled by a register control section (14–14*c*) are provided, and on the occasion of high-resolution mode, a signal line drive processing section 15 determines the timings of driving respective scanning signal lines GL1–GLm, in accordance with output signals from all of the shift registers, while on the occasion of low-resolution mode, the signal line drive processing section 15 stops the operation of some of the shift registers and determines the timings of driving the respective scanning signal lines GL1–GLm, in accordance with output signals from the remaining shift registers, and (ii) as in the data signal line drive circuit 3*f* in accordance with Third Embodiment, a scanning circuit section (12*f*) controlled by a register control section 14*f* is provided, and on the occasion of high-resolution mode, a signal line drive processing section 15 determines the timings of driving respective scanning signal lines GL1–GLm, in accordance with output signals from all latch circuits of a shift register SR1, while on the occasion of low-resolution mode, the signal line drive processing section 15 stops the operation of some of the latch circuits of the shift register SR1 and determines the timings of driving respective scanning signal lines GL1–GLm, in accordance with output signals from the remaining latch circuits.

Here, when the present invention is adopted to a scanning signal line drive circuit, on the occasion of high-resolution mode, a scanning circuit section instructs timings which are different from each other to respective signal line units for driving the respective scanning signal lines, by using, for instance, edges of a signal. In this case, on the occasion of high-resolution mode, each of the signal line drive units carries out exclusive control so as to prevent the overlap between a period in which one signal line drive unit outputs a signal indicating the selection to a corresponding scanning signal line GLj and a period in which another signal line drive unit outputs a signal indicating the selection to a corresponding scanning signal line, by, for instance, performing logical operations with respect to a timing signal supplied to the signal line drive unit itself and timing signals supplied to neighboring signal line drive units.

In the case of a matrix image display device, the sampling cycles of respective data signal lines SL1–SLn are significantly shorter than the cycles of timings of switching respective scanning signal lines GL1–GLm, so that the power consumption of a data signal line drive circuit is larger than that of a scanning signal line drive circuit. Thus, when either one of the data signal line drive circuit or the scanning signal line drive circuit of the image display device is selected, it is preferable that either a plurality of shift registers of respective systems are provided or a shift register which is arranged such that some of latch circuits can be bypassed in accordance with the signal line resolution is provided in the data signal line drive circuit. Here, it is possible to further reduce the power consumption by providing a plurality of shift registers of respective systems in both the data signal line drive circuit and the scanning signal line drive circuit.

As described above, the signal line drive circuit (3, 3*a*–3*d*, 4*g*) in accordance with the present invention comprises a scanning section (12, 12*a*–12*d*) for outputting timing signals to respective signal line drive sections (SU1 . . . , 15) provided in accordance with a plurality of signal lines (SL1 . . . , GL1 . . . ), the timing signals specifying timings of the signal line drive sections being operated in accordance with an input signal, wherein, the scanning section includes: a plurality of shift registers (SRA–SRC) of respective systems; and control means (14, 14*b*, 14*c*) for controlling operation or non-operation of at least one of the shift registers of respective systems, in accordance with signal line resolution of the input signal.

In this arrangement, it is possible to control the number of the shift registers, of respective systems, to be operated, in accordance with the signal line resolution of the input signal. Thus, in accordance with the signal line resolution, i.e. in accordance with the number of timings instructed to the signal line drive sections on occasion when the signal line drive sections, which are for driving signal lines, are operated in accordance with the input signal, the total number of the stages of at least one shift register which has been operated can be controlled. As a result, the scanning section can output the timing signals which indicate operating timings of the signal line drive sections, without hindrance.

Moreover, when the signal line resolution is low, a part of the shift register is stopped and this makes it possible to reduce the power consumption to be lower than the power consumption in the arrangement of conventional art, i.e. the arrangement in which the total number of stages of a shift register which has been operated is unchanged, regardless of the level of the signal line resolution.

Consequently, on the both occasions of the input of an input signal of high signal line resolution and the input of an input signal of low signal line resolution, although proper operating timings can be instructed to respective signal line drive sections, a signal line drive circuit which consumes a small amount of electricity can be realized.

Further, the signal line drive circuit (3, 3*a*–3*d*, 4*g*) in accordance with the present invention comprises a scanning section (12, 12*a*–12*d*) for outputting timing signals to respective signal line drive sections (SU1 . . . , 15) provided in accordance with the plurality of signal lines (SL1 . . . , GL1 . . . ), the timing signals specifying timings of the signal line drive sections being operated in accordance with an input signal, wherein, the scanning section includes: first and second shift registers (SRA–SRC) each belonging to a different system; and control means (14, 14*b*, 14*c*) which causes the first and second shift registers to be operated in case of high-resolution mode, and causes the first shift register (SRB, SRA, SRB and SRC, SRA and SRC, SRA and SRB) to be stopped in case of low-resolution mode in which mode an input signal whose signal line resolution is lower than that of an input signal in the case of high-resolution mode is supplied. Here, each of the first and second shift registers may be a shift register of a single system, or may be a plurality of shift registers of respective systems.

In this arrangement, on the occasion of high-resolution mode, the control means causes both of the first and second shift registers to be operated so that the total number of the stages of the shift registers which has been operated is larger than the number on the occasion of low-resolution mode. Thus, the signal line resolution of the input signal in this case is higher than the signal line resolution on the occasion of low-resolution mode, and hence the scanning section can output the timing signals specifying the operating timings of the signal line drive sections without hindrance, even if there are a lot of timings to be instructed to the signal line drive sections on occasion when the signal line drive sections are operated in accordance with the input signal for driving the signal lines, such as timings for sampling the data included in the input signal and timings for switching lines corresponding to the data included in the input signal.

In contrast, on the occasion of low-resolution mode, the control means causes the first shift register to be stopped, while the second shift register to be operated. In this case, the number of the stages of the shift register to be operated is fewer than the number on the occasion of high-resolution mode, so that the number of timings to be instructed to the respective signal line drive sections is also few. Thus, even if the first shift register has been in the state of non-operation, the scanning section can output the timing signals specifying the foregoing timings to the signal line drive sections without hindrance.

In the foregoing arrangement, the first shift register has been stopped on the occasion of low-resolution mode. Moreover, since the first shift register belongs to a system different from a system to which the second shift register belongs, the arrangement enables to reduce the power consumption to be smaller than the power consumption in the case of the arrangement of the conventional art, i.e. the arrangement in which, regardless of the signal line resolution, the total number of the stages of the shift registers which have been operated is unchanged.

Incidentally, Incidentally, provided that one shift register of a single system is provided and a pulse is shifted bypassing some stages on the occasion of low-resolution mode, it is possible to restrain the operating speed which is necessary for the second register. Thus, the foregoing arrangement enables to constitute the second shift register by a circuit which consumes a smaller amount of electricity.

Consequently, on the both occasions of the input of input signal of high signal line resolution and the input of input signal of low signal line resolution, a signal line drive circuit which consumes a small amount of electricity can be realized, while proper operating timings can be instructed to respective signal line drive sections.

Incidentally, the number of the stages of the second shift register can be arbitrarily determined, on condition that the outputs from the respective stages of the second shift register can specify the operating timings corresponding to the input signal of low-resolution. Further, the number of the stages of the first shift register can be arbitrarily determined, on condition that the outputs from the respective stages of the first and second shift registers can specify the operating timings corresponding to the input signal of high-resolution. However, when the reduction of the number of the stages is required, it is preferable that the total number of the stages of the second shift register is in concord with the signal line resolution of the input signal of low-resolution, and the total number of the stages of the first shift register is identical with the value of the signal line resolution of the input signal of high-resolution minus the signal line resolution of the input signal of low-resolution.

Moreover, in addition to the above, an additional signal line drive section (21) for driving at least one of signal lines driven by the foregoing signal line drive sections may be provided. According to this arrangement, for instance, by displaying an image whose quality is different from that of an image displayed by the first signal line drive circuit, it is possible to further reduce the power consumption.

The signal line drive circuit (3, 3*a*–3*d* and 21) in accordance with the present invention comprises a first signal line drive circuit (3, 3*a*–3*d*) including a scanning section (12, 12*a*–12*d*) for outputting timing signals to respective signal line drive sections (SU1 . . . ) provided in accordance with a plurality of signal lines (SL1 . . . , GL1 . . . ), the timing signals specifying timings of the signal line drive sections being operated in accordance with an input signal, wherein, the scanning section includes: a plurality of shift registers (SRA–SRC) of respective systems; and control means (14, 14*b*, 14*c*) which causes the first and second shift registers to be operated in case of high-resolution mode, and causes the first shift register (SRB, SRA, SRB and SRC, SRA and SRC, SRA and SRB) to be stopped in case of low-resolution mode in which mode an input signal whose signal line resolution is lower than that of an input signal in the case of high-resolution mode is supplied, and also the signal line drive circuit (3, 3*a*–3*d* and 21) in accordance with the present invention is further provided with a second signal line drive circuit (21) which shares at least one of the foregoing signal lines with the first signal line drive circuit. Here, each of the first and second shift registers may be a shift register of a single system, or may be a plurality of shift registers of respective systems. The numbers of the stages of the respective first and second shift registers can be configured as in the foregoing signal line drive circuits.

Also in this arrangement, the first shift register stops operating on the occasion of the low-resolution mode, as in the case of the foregoing signal line drive circuit. With this arrangement, no matter which one of the input signal with high signal line resolution and the input signal with low signal line resolution is supplied, it is possible to realize a signal line drive circuit with low power consumption, even if correct operating timings can be specified to the signal line drive sections.

Further, thanks to the drive of signal lines by the second signal line drive circuit which shares at least one of the signal lines with the first signal line drive circuit, for instance, it is possible to display an image with display quality different from that of an image displayed by the first signal line drive circuit.

Moreover, in addition to the foregoing arrangements, the signal line drive sections may be arranged in such a manner that the signal line drive sections are sampling circuits (SU1 . . . ) for sampling the input signal at timings specified by the timing signals, and the signal line drive circuit is operated as a data signal line drive circuit (3, 3*a*–3*d*).

With this arrangement, it is possible to realize a data signal line drive circuit of low-power consumption type, at the same time both the input signal of high signal line resolution and the input signal of low signal line resolution can be properly sampled.

Further, in addition to the foregoing arrangements, the scanning section (12, 12*a*–12*d*) may include switching means (13, 13*a*–13*d*) which switches signals paths, for achieving an arrangement such that, (i) in the case of high-resolution mode, shifted signals are transmitted from respective stages of the second shift register (SRA, SRB, SRA, SRB, SRC) to the corresponding sampling circuits and from respective stages of the first shift register to the corresponding sampling circuits, and (ii) in the case of low-resolution mode, shifted signals are transmitted from respective stages of the second shift register to the corresponding sampling circuits and the sampling circuits corresponding to respective stages of the first shift register.

According to this arrangement, on the occasion of low-resolution mode, signal paths from the respective stages of the second shift register to the sampling circuits corresponding to the respective stages of the first and second shift registers are formed, and in accordance with the timing signal from one stage of the second shift register, a plurality of sampling circuits sample the input signal. On this account, it is possible to write the data having an identical value to the data signal lines corresponding to these sampling circuits, on the occasion of low-resolution mode. Thus, it is possible to adjust apparent signal line resolution of the data signal lines driven by the data signal line drive circuit, in accordance with the resolution of the input signal.

Moreover, in addition to the foregoing arrangements, it is preferable that the first and second shift registers are operated in sync with clock signals each transmitted via a different clock signal line, and the signal line drive circuit further comprises clock signal control means (6, 6*b*) which stops supply of the clock signal to the first shift register in the case of low-resolution mode, and supplies the clock signals each specifying a different shift timing to both of the first and second shift registers, in the case of high-resolution mode.

In this arrangement, on the occasion of high-resolution mode, the clock signals each specifying a different shift timing are supplied to the first and second shift registers, respectively. Thus, the stages of the first and second shift registers can output signals each having a different timing.

In contrast, on the occasion of low-resolution mode, the first shift register is in the state of non-operation and the supply of the clock signal to the first shift register is stopped. Thus, it is possible to reduce the power consumption of a circuit for generating a clock signal supplied to the first shift register, so that it is possible to reduce the power consumption of the whole arrangement including the signal line drive circuit and the clock signal control means.

Here, even on the occasion of low-resolution mode, the clock signal supplied to the second shift register pass through a clock signal line different from a clock signal line for supplying a clock signal to the first shift register, and hence the signal line drive circuit can drive the signal lines at operating timings in accordance with the input signal, without hindrance.

The signal line drive circuit (3*f*, 4*g*) in accordance with the present invention comprises a scanning section (12*f*) for outputting timing signals to respective signal line drive sections (SU1 . . . , 15) provided in accordance with a plurality of signal lines (SL1 . . . , GL1 . . . ), the timing signals specifying timings of the signal line drive sections being operated in accordance with an input signal, wherein, the scanning section includes: a shift register (SR1); and control means (14*f*) which (i) determines whether or not shifted signals are shifted bypassing one stage of the shift register, in accordance with signal line resolution of the input signal, and (ii) stops operation of the stage which has been bypassed.

In this arrangement, on the occasion of low-resolution mode in which mode an input signal whose signal line resolution is lower than the signal line resolution of an input signal on the occasion of high-resolution mode is supplied, the control means causes shifted signals to be shifted bypassing one of the stages of the shift register. In this case, the number of stages of the shift register which has been operated is smaller than the number of stages on occasion when no stages are bypassed. However, since the signal line resolution of the input signal in this case is lower than the same on the occasion of high-resolution mode, the number of timings to be instructed to the signal line drive sections also becomes fewer. On this account, although the shifted signal is shifted bypassing one stage of the shift register, the scanning section can output the timing signals, which specify the foregoing timings, to the signal line drive sections without hindrance, and at the same time the scanning section can cause the stage(s), which has (have) been bypassed, to be stopped.

Consequently, on the both occasions of the input of an input signal of high signal line resolution and the input of an input signal of low signal line resolution, although proper operating timings can be instructed to respective signal line drive sections, a signal line drive circuit which consumes a small amount of electricity can be realized.

Further, in addition to the foregoing arrangements, the signal line drive circuit may be arranged in such a manner that the control means causes the shifted signal to be shifted without bypassing any one of the stages of the shift register on the occasion of high-resolution mode, while the control means causes the shift signal to be shifted bypassing either odd-number-th stages or even-number-th stages, on the occasion of low-resolution mode in which mode an input signal whose signal line resolution is lower than the signal line resolution of an input signal on the occasion of high-resolution mode is supplied.

In this arrangement, timing generation signals can be outputted in accordance with output signals from all stages of the shift register on the occasion of high-resolution mode, while the shifted signals are shifted bypassing either odd-number-th stages or even-number-th stages on the occasion of low-resolution mode, so that on the both occasions of the input of the input signal of signal line resolution at ×1 magnification and the input of the input signal of signal line resolution at ×2 magnification, although proper operating timings can be instructed to respective signal line drive sections, a signal line drive circuit which consumes a small amount of electricity can be realized.

Moreover, in addition to the foregoing arrangements, the signal line drive circuit may be arranged in such a manner that: the signal line drive sections are sampling circuits (SU1 . . . ) for sampling the input signal at timings specified by the timing signals; the scanning section includes switching means (13*f*) which switches signal paths, for achieving an arrangement such that, (i) in the case of high-resolution mode, shifted signals are transmitted from each stage of the shift register to the corresponding sampling circuits, and (ii) in the case of low-resolution mode, shifted signals are transmitted from either the even-number-th stages or the odd-number-th stages of the shift register to the sampling circuits corresponding to both the even-number-th stages and the odd-number-th stages; and the signal line drive circuit is operated as a data signal line drive circuit (3*f*).

In this arrangement, on the occasion of low-resolution mode, signal paths from either even-number-th stages or odd-number-th stages of the shift register to the sampling circuits corresponding to the both even-number-th and odd-number-th stages are formed, and in accordance with the timing signal from one stage, two sampling circuits sample an input signal. On this account, on the occasion of low-resolution mode, it is possible to write the data having an identical value to the data signal lines corresponding to these sampling circuits. Thus, it is possible to adjust apparent signal line resolution of the data signal lines driven by the data signal line drive circuit, in accordance with the resolution of the input signal.

Further, in addition to the foregoing arrangements, the signal line drive circuit may comprise clock signal control means (6*f*) for controlling the frequency of the clock signal in accordance with the signal line resolution. In this arrangement, the frequency of the clock signal supplied to the shift register are controlled in accordance with the signal resolution, so that it is possible to reduce the power consumption of the whole arrangement including the signal line drive circuit and the clock signal control means.

Moreover, the display device (1, 1*h*) in accordance with the present invention comprises: a plurality of data signal lines (SL1 . . . ); a plurality of scanning signal lines (GL1 . . . ) intersecting with the plurality of data signal lines; pixels (PIX . . . ) which correspond to respective pairs of the plurality of data signal lines and the plurality of scanning signal lines, so as to be provided as, for instance, a matrix manner; a scanning signal line drive circuit (4, 4*g*) for driving the scanning signal lines; and a data signal line drive circuit (3, 3*a*–3*f*) for outputting output signals, which correspond to respective sampling results supplied from sampling circuits (SU1 . . . ) provided in accordance with the plurality of data signal lines, to the plurality of data signal lines, wherein at least one of the scanning signal line drive circuit and the data signal line drive circuit is one of the foregoing signal line drive circuits.

The signal line drive circuits with the foregoing arrangements consume a small amount of electric power, but at the same time the signal line drive sections can drive the respective signal lines at proper operating timings, on the both occasions of the input of an input signal of high signal line resolution and the input of an input signal of low signal line resolution. Thus, adopting one of the foregoing signal line drive circuits as at least one of the scanning signal line drive circuit and the data signal line drive circuit makes it possible to realize a display device which can properly display both an image signal of high resolution and an image signal of low-resolution and at the same time consumes a small amount of electricity.

Further, the image display device (1*h*) in accordance with the present invention is an image display device using a signal line drive circuit (3, 3*a*–3*f* and 21) provided with a first signal line drive circuit (3, 3*a*–3*f*) and a second signal line drive circuit (21), and includes: a plurality of data signal lines (SL1 . . . ); a plurality of scanning signal lines (GL1 . . . ) intersecting with the plurality of data signal lines; pixels (PIX . . . ) provided in a matrix manner and corresponding to respective pairs of the plurality of data signal lines and the plurality of scanning signal lines; a scanning signal line drive circuit (4) for sequentially driving the plurality of scanning signal lines; and a data signal line drive circuit (3, 3*a*–3*f*) for outputting output signals, which correspond to respective sampling results supplied from sampling circuits (SU1 . . . ) provided in accordance with the plurality of data signal lines, to the plurality of data signal lines, wherein, the data signal drive circuit is the first signal line drive circuit, and the second signal line drive circuit shares at least one of the plurality of data signal lines with the first signal line drive circuit.

The data signal line drive circuit with the foregoing arrangement consumes low power despite that the respective signal line drive sections can drive the signal lines at correct operating timings, no matter which one of the input signal with high signal line resolution and the input signal with low signal line resolution is supplied. Thus, using this signal line drive circuit as the data signal line drive circuit enables to realize an image display device which can display both a high-resolution image signal and a low-resolution image signal at the same time consumes low power.

Further, the signal lines are driven by the second signal line drive circuit which shares at least one of the signal lines with the first signal line drive circuit, and hence, for instance, by displaying an image whose quality is different from that of an image displayed by the first signal line drive circuit, it is possible to realize an image display device with lower power consumption.

In addition to the foregoing arrangements, when the cost reduction is required, it is preferable that the pixels, the data signal line drive circuit, and the scanning signal line drive circuit are formed on a single substrate.

According to this arrangement, since the pixels, the data signal line drive circuit, and the scanning signal line drive circuit are formed on a single substrate, it is possible to reduce the manufacturing costs and mounting costs of the drive circuits, compared with the arrangement such that the drive circuits are formed on different substrates and then these substrates are connected.

Further, in addition to the foregoing arrangements, active elements constituting the pixels, the data signal line drive circuit, and the scanning signal line drive circuit may be polycrystalline silicon thin-film transistors.

According to this arrangement, it is possible to enlarge the size of the substrate, compared with the case of forming the active elements by single crystal silicon transistors. On this account, it is possible to manufacture a display device consuming a small amount of electricity and also having a larger screen.

Moreover, in addition to the foregoing arrangements, the active elements may be formed on a glass substrate, by a process at a temperature not more than 600° C. According to this arrangement, since the active elements are formed in a process not more than 600° C., so that the active elements can be formed on the glass substrate. According to this arrangement, since the active elements are manufactured at a temperature not more than 600° C., it is possible to form the active elements on a grass substrate. As a result, it is possible to manufacture a display device which consumes a small amount of electricity and has a large screen at low cost.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A signal line drive circuit, comprising:

a scanning section for outputting timing signals to respective signal line drive sections provided in correspondence with a plurality of signal lines, the timing signals specifying a timing at which the signal line drive sections are operated, wherein, the scanning section includes:

a plurality of shift registers of respective systems; and control means for controlling operation or non-operation of at least one of the shift registers of respective systems, in accordance with signal line resolution of the input signal.

2. The signal line drive circuit as defined in claim 1, wherein the signal line drive sections are sampling circuits for sampling the input signal at timings specified by the respective timing signals, and the signal line drive circuit is operated as a data signal line drive circuit.

3. The signal line drive circuit as defined in claim 1, further comprising an additional signal line drive section which drives at least one of signal lines driven by the signal line drive sections.

4. A display device, comprising:

a plurality of data signal lines;

a plurality of scanning signal lines intersecting with the plurality of data signal lines;

pixels corresponding to respective pairs of the plurality of data signal lines and the plurality of scanning signal lines;

a scanning signal line drive circuit for driving the plurality of scanning signal lines; and a data signal line drive circuit for outputting output signals, which correspond to respective sampling results supplied From sampling circuits provided in correspondence with the plurality of data signal lines, to the plurality of data signal lines, wherein, the scanning signal line drive circuit is provided with a scanning section for outputting timing signals to respective signal line drive sections provided in correspondence with the plurality of data signal lines, the timing signals specify timings at which the signal line drive sections are operated, and the scanning section includes a plurality of shift registers of respective systems and control means for controlling operation or non-operation of at least one of the shift registers of respective systems, in accordance with signal line resolution of the input signal.

5. The display device as defined in claim 4, wherein the pixels, the data signal line drive circuit, and the scanning signal line drive circuit are formed on a single substrate.

6. The display device as defined in claim 5, wherein active elements constituting the pixels, the data signal line drive circuit, and the scanning signal line drive circuit are polycrystalline silicon thin-film transistors.

7. The display device as defined in claim 6, wherein the active elements are formed on a glass substrate, by a process at a temperature not more than 600° C.

8. A display device, comprising:

a plurality of data signal lines;

a plurality of scanning signal lines intersecting with the plurality of data signal lines;

pixels corresponding to respective pairs of the plurality of data signal lines and the plurality of scanning signal lines;

a scanning signal line drive circuit for driving the plurality of scanning signal lines; and a data signal line drive circuit for outputting output signals, which correspond to respective sampling results supplied from sampling circuits provided in correspondence with the plurality of data signal lines, to the plurality of data signal lines, wherein, the data signal line drive circuit is provided with a scanning section for outputting timing signals to respective signal line drive sections provided in correspondence with the plurality of data signal lines, the timing signals specify timings at which the signal line drive sections are operated, and the scanning section includes a plurality of shift registers of respective systems and control means for controlling operation or non-operation of at least one of the shift registers of respective systems, in accordance with signal line resolution of the input signal.

9. The display device as defined in claim 8, wherein the pixels, the data signal line drive circuit, and the scanning signal line drive circuit are formed on a single substrate.

10. The display device as defined in claim 9, wherein active elements constituting the pixels, the data signal line drive circuit, and the scanning signal line drive circuit are polycrystalline silicon thin-film transistors.

11. The display device as defined in claim 10, wherein the active elements are formed on a glass substrate, by a process at a temperature not more than 600° C.

12. The display device as defined in claim 8, further comprising an additional signal line drive section which drives at least one of signal lines driven by the signal line drive sections.

13. A signal line drive circuit, comprising:

a scanning section for outputting timing signals to respective signal line drive sections provided in accordance with a plurality of signal lines, the timing signals specifying timings of the signal line drive sections being operated in accordance with an input signal, wherein, the scanning section includes:

first and second shift registers each belonging to a different system; and control means which causes the first and second shift registers to be operated in case of high-resolution mode, and causes the first shift register to be stopped in case of low-resolution mode in which mode an input signal whose signal line resolution is lower than that of an input signal in the case of high-resolution mode is supplied.

14. The signal line drive circuit as defined in claim 13, wherein the signal line drive sections are sampling circuits for sampling the input signal at timings specified by the timing signals, and the signal line drive circuit is operated as a data signal line drive circuit.

15. The signal line drive circuit as defined in claim 13, wherein:

the signal line drive sections are sampling circuits for sampling the input signal at timings specified by the timing signals;

the scanning section includes switching means which switches signals paths, for achieving an arrangement such that, (i) in the ease of high-resolution mode, shifted signals are transmitted from respective stages of the second shift register to the corresponding sampling circuits and from respective stages of the first shift register to the corresponding sampling circuits, and (ii) in the case of low-resolution mode, shifted signals are transmitted from respective stages of the second shift register to the corresponding sampling circuits and the sampling circuits corresponding to respective stages of the first shift register; and the signal line drive circuit is operated as a data signal line drive circuit.

16. The signal line drive circuit as defined in claim 13, in which the first and second shift registers are operated in sync with clock signals each transmitted via a different clock signal line, the signal line drive circuit further comprising clock signal control means which stops supply of the clock signals to the first shift register in the case of low-resolution mode, and supplies the clock signal specifying different shift timings to the first and second shift registers, in the case of high-resolution mode.

17. The signal line drive circuit as defined in claim 13, further comprising an additional signal line drive section which drives at least one of signal lines driven by the signal line drive sections.

18. A display device, comprising:

a plurality of data signal lines;

a plurality or scanning signal lines intersecting with the plurality of data signal lines;

pixels corresponding to respective pairs of the plurality of data signal lines and the plurality of scanning signal lines;

a scanning signal line drive circuit for driving the plurality of scanning signal lines; and a data signal line drive circuit for outputting output signals, which correspond to respective sampling results supplied from sampling circuits provided in accordance with the plurality of data signal lines, to the plurality of data signal lines, wherein, the scanning signal drive circuit is provided with a scanning section for outputting timing signals to respective signal line drive sections provided in accordance with the plurality of scanning signal lines, the timing signals specifying timings of the signal line drive sections being operated in accordance with an input signal, and the scanning section includes:

first and second shift registers each belonging to a different system; and control means which causes the first and second shift registers to be operated in case of high-resolution mode, and causes the first shift register to be stopped in case of low-resolution mode in which mode an input signal whose signal line resolution is lower than that of an input signal in the case of high-resolution mode is supplied.

19. The display device as defined in claim 18, wherein the pixels, the data signal line drive circuit, and the scanning signal line drive circuit are formed on a single substrate.

20. The display device as defined on claim 19, wherein active elements constituting the pixels, the data signal line drive circuit, and the scanning signal line drive circuit are polycrystalline silicon thin-film transistors.

21. The display device as defined in claim 20, wherein the active elements are formed on a glass substrate, by a process at a temperature not more than 600° C.

22. A display device, comprising:

a plurality of data signal lines;

a plurality of scanning signal lines intersecting with the plurality of data signal lines;

pixels corresponding to respective pairs of the plurality of data signal lines and the plurality of scanning signal lines;

a scanning signal line drive circuit for driving the plurality of scanning signal lines; and a data signal line drive circuit for outputting output signals, which correspond to respective sampling results supplied from sampling circuits provided in accordance with the plurality of data signal lines, to the plurality of data signal lines, wherein, the data signal drive circuit is provided with a scanning section for outputting timing signals to respective signal line drive sections provided in accordance with the plurality of data signal lines, the timing signals specifying timings of the signal line drive sections being operated in accordance with an input signal, and the scanning section includes;

first and second shift registers each belonging to a different system; and control means which causes the first and second shift registers to be operated in case of high-resolution mode, and causes the first shift register to be stopped in case of low-resolution mode in which mode an input signal whose signal line resolution is lower than that of an input signal in the case of high-resolution mode is supplied.

23. The display device as defined in claim 22, wherein the pixels, the data signal line drive circuit, and the scanning signal line drive circuit are formed on a single substrate.

24. The display device as defined in claim 23, wherein active elements constituting the pixels, the data signal line drive circuit, and the scanning signal line drive circuit are polycrystalline silicon thin-film transistors.

25. The display device as defined in claim 24, wherein the active elements are formed on a glass substrate, by a process at a temperature not more than 600° C.

26. The display device as defined in claim 22, further comprising an additional signal line drive section which drives at least one of signal lines driven by the signal line drive sections.

27. A signal line drive circuit comprising:

a scanning section for outputting timing signals to respective signal line drive sections provided in accordance with a plurality of signal lines, the timing signals specifying timings of the signal line drive sections being operated in accordance with an input signal, wherein, the scanning section includes:

a shift register; and control means which (i) determines whether or not a shifted signal is shifted bypassing at least one stage of the shift register, in accordance with signal line resolution of the input signal, and (ii) stops operation of the stage which has been bypassed.

28. The signal line drive circuit as defined in claim 27, wherein, the control means causes a shifted signal to be shifted without bypassing any one of stages of the shift register, in case of high-resolution mode, and causes a shifted signal to be shifted bypassing either odd-number-th stages or even-number-th stages of the shift register, in case of low-resolution mode in which mode an input signal whose signal line resolution is lower than that of input signal in the high-resolution mode is supplied.

29. The signal line drive circuit as defined in claim 28, wherein:

the signal line drive sections are sampling circuits for sampling the input signal at timings specified by the timing signals;

the scanning section includes switching means which switches signal paths, for achieving an arrangement such that, (i) in the case of high-resolution mode, shifted signals are transmitted from each stage of the shift register to the corresponding sampling circuits, and (ii) in the case of low-resolution mode, shifted signals are transmitted from either the even-number-th stages or the odd-number-th stages of the shift register to the sampling circuits corresponding to both the even-number-th stages and the odd-number-th stages; and the signal line drive circuit is operated as a data signal line drive circuit.

30. The signal line drive circuit as defined in claim 27, further comprising clock signal control means for controlling frequency of the clock signal in accordance with the signal line resolution.

31. The signal line drive circuit as defined in claim 27, further comprising an additional signal line drive section which drives at least one of signal lines driven by the signal line drive sections.

32. A display device, comprising:

a plurality of data signal lines;

a plurality of scanning signal lines intersecting with the plurality of data signal lines;

pixels corresponding to respective pairs of the plurality of data signal lines and the plurality of scanning signal lines;

a scanning signal line drive circuit for driving the plurality of scanning signal lines; and a data signal line drive circuit for outputting output signals, which correspond to respective sampling results supplied from sampling circuits provided in accordance with the plurality of data signal lines, to the plurality of data signal lines, wherein, the scanning signal drive circuit is provided with a scanning section for outputting timing signals to respective signal line drive sections provided in accordance with the plurality of scanning signal lines, the timing signals specifying timings of the signal line drive sections being operated in accordance with an input signal, and the scanning section includes:

a shift register; and control means which (i) determines whether or not a shifted signal is shifted bypassing at least one stage of the shift register, in accordance with signal line resolution of the input signal, and (ii) stops operation of the stage which has been bypassed.

33. The display device as defined in claim 32, wherein the pixels, the data signal line drive circuit, and the scanning signal line drive circuit are formed on a single substrate.

34. The display device as defined in claim 33, wherein active elements constituting the pixels, the data signal line drive circuit, and the scanning signal line drive circuit are polycrystalline silicon thin-film transistors.

35. The display device as defined in claim 34, wherein the active elements are formed on a glass substrate, by a process at a temperature not more than 600° C.

36. A display device, comprising:

a plurality of data signal lines;

a plurality of scanning signal lines intersecting with the plurality of data signal lines;

pixels corresponding to respective pairs of the plurality of data signal lines and the plurality of scanning signal lines;

a scanning signal line drive circuit for driving the plurality of scanning signal lines; and a data signal line drive circuit for outputting output signals, which correspond to respective sampling results supplied from sampling circuits provided in accordance with the plurality of data signal lines, to the plurality of data signal lines, wherein, the data signal drive circuit is provided with a scanning section for outputting timing signals to respective signal line drive sections provided in accordance with the plurality of data signal lines, the timing signals specifying timings of the signal line drive sections being operated in accordance with an input signal, and the scanning section includes:

a shift register; and control means which (i) determines whether or not a shifted signal is shifted bypassing at least one stage of the shift register, in accordance with signal line resolution of the input signal, and (ii) stops operation of the stage which has been bypassed.

37. The display device as defined in claim 36, wherein the pixels, the data signal line drive circuit, and the scanning signal line drive circuit are formed on a single substrate.

38. The display device as defined in claim 37, wherein active elements constituting the pixels, the data signal line drive circuit, and the scanning signal line drive circuit are polycrystalline silicon thin-film transistors.

39. The display device as defined in claim 38, wherein the active elements are formed on a glass substrate, by a process at a temperature not more than 600° C.

40. The display device as defined in claim 36, further comprising an additional signal line drive section which drives at least one of signal lines driven by the signal line drive sections.

41. A signal line drive circuit, comprising:

a first signal line drive circuit provided with a scanning section for outputting timing signals to respective signal line drive sections provided in accordance with a plurality of signal lines, the timing signals specifying timings of the signal line drive sections being operated in accordance with an input signal, wherein, the scanning section includes:

first and second shift registers each belonging to a different system;

control means which causes the first and second shift registers to be operated in case of high-resolution mode, and causes the first shift register to be stopped in case of low-resolution mode in which mode an input signal whose signal line resolution is lower than that of an input signal in the case of high-resolution mode is supplied; and a second signal line drive circuit which shares at least one of the plurality of signal lines with the first signal line drive circuit.

42. The signal line drive circuit as defined in claim 41, wherein the signal line drive sections are sampling circuits for sampling the input signal at timings specified by the timing signals, and the signal line drive circuit is operated as a data signal line drive circuit.

43. The signal line drive circuit as defined in claim 42, wherein, the scanning section includes switching means which switches signals paths, for achieving an arrangement such that, (i) in the case of high-resolution mode, signals are transmitted from respective stages of the second shift register to the corresponding sampling circuits and from respective stages of the first shift register to the corresponding sampling circuits, and (ii) in the case of low-resolution mode, signals are transmitted from respective stages of the second shift register to the corresponding sampling circuits and the sampling circuits corresponding to respective stages of the first shift register.

44. The signal line drive circuit as defined in claim 41, in which the first and second shift registers are operated in sync with clock signals each transmitted via a different clock signal line, the signal line drive circuit further comprising clock signal control means which stops supply of the clock signals to the first shift register in the case of low-resolution mode, and supplies the clock signal specifying different shift timings to the first and second shift registers, in the case of high-resolution mode.

45. An image display device, comprising:

a plurality of data signal lines;

a plurality of scanning signal lines intersecting with the plurality of data signal lines;

pixels provided in a matrix manner and corresponding to respective pairs of the plurality of data signal lines and the plurality of scanning signal lines;

a scanning signal line drive circuit for sequentially driving the plurality of scanning signal lines; and a signal line drive circuit provided with a first signal line drive circuit and a second signal line drive circuit, wherein, the first signal line drive circuit is a data signal line drive circuit which outputs signals, which correspond to respective sampling results supplied from sampling circuits provided in accordance with the plurality of data signal lines, to the plurality of data signal lines, the data signal drive circuit is provided with a scanning section for outputting timing signals to respective signal line drive sections provided in accordance with the plurality of data signal lines, the timing signals specifying timings of the signal line drive sections being operated in accordance with an input signal, and the scanning section includes:

first and second shift registers each belonging to a different system; and control means which causes the first and second shift registers to be operated in case of high-resolution mode, and causes the first shift register to be stopped in case of low-resolution mode in which mode an input signal whose signal line resolution is lower than that of an input signal in the case of high-resolution mode is supplied, the second signal line drive circuit sharing at least one of the plurality of data signal lines with the first signal line drive circuit.

46. The image display device as defined in claim 45, wherein the pixels, the data signal line drive circuit, and the scanning signal line drive circuit are formed on a single substrate.

47. The image display device as defined in claim 46, wherein active elements constituting the pixels, the data signal line drive circuit, and the scanning signal line drive circuit are polycrystalline silicon thin-film transistors.

48. The image display device as defined in claim 45, wherein the active elements are formed on a glass substrate, by a process at a temperature not more than 600° C.

* * * * *